US011840947B2

(12) United States Patent
Matsumoto

(10) Patent No.: US 11,840,947 B2
(45) Date of Patent: Dec. 12, 2023

(54) STRADDLE-TYPE VEHICLE

(71) Applicant: SUZUKI MOTOR CORPORATION, Hamamatsu (JP)

(72) Inventor: Akio Matsumoto, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 18/296,223

(22) Filed: Apr. 5, 2023

(65) Prior Publication Data

US 2023/0349313 A1 Nov. 2, 2023

(30) Foreign Application Priority Data

May 2, 2022 (JP) ..... 2022-075990

(51) Int. Cl.
*F01N 13/00* (2010.01)
*F01N 13/08* (2010.01)

(52) U.S. Cl.
CPC ..... *F01N 13/009* (2014.06); *F01N 13/082* (2013.01); *F01N 2590/04* (2013.01)

(58) Field of Classification Search
CPC ..... F01N 13/009; F01N 13/08; F01N 13/14; F01N 2260/20; F01N 2340/04; F01N 2560/025; F01N 2590/04
See application file for complete search history.

(56) References Cited

U.S. PATENT DOCUMENTS 6,315,072 B1 * 11/2001 Brown ..... B62K 11/04 180/230
8,393,433 B2 * 3/2013 Inoue ..... F01N 13/141 180/89.2
11,603,163 B2 * 3/2023 Wang ..... B62M 6/55
2006/0236685 A1 * 10/2006 Ueshima ..... F01N 13/04 60/299
2008/0000707 A1 * 1/2008 Gruber ..... B62K 11/04 180/219
2008/0060864 A1 * 3/2008 Arai ..... F01N 13/009 60/299
2011/0192669 A1 * 8/2011 Yokoi ..... F01N 3/10 180/219
2020/0263584 A1 * 8/2020 Yagi ..... B60K 13/04
2020/0271042 A1 * 8/2020 Hayama ..... F01N 3/2842
2020/0291843 A1 * 9/2020 Kubo ..... F01N 13/00
2020/0324846 A1 * 10/2020 Yamamoto ..... B62K 11/04
2022/0042448 A1 * 2/2022 Makita ..... F01N 1/00

FOREIGN PATENT DOCUMENTS

JP 2008-064068 A 3/2008

* cited by examiner

*Primary Examiner* — Anthony Ayala Delgado
(74) *Attorney, Agent, or Firm* — Stein IP, LLC

(57) ABSTRACT

There is provided a straddle-type vehicle. An exhaust pipe includes a first portion extending downward from an exhaust port through a region in front of an engine and on one lateral side of a down frame in the left-right direction, a second portion extending upward through a region in front of the engine and on the other lateral side of the down frame in the left-right direction after extending from a downstream side end portion of the first portion to the other lateral side of the down frame in the left-right direction through a region in front of or to the lower front of the down frame. The catalyst device is disposed in a portion of the second portion of the exhaust pipe that is located in front of the engine and on the other lateral side of the down frame in the left-right direction.

10 Claims, 8 Drawing Sheets

STRADDLE-TYPE VEHICLE

CROSS-REFERENCE TO RELATED APPLICATIONS

This application is based on Japanese Patent Application No. 2022-075990 filed on May 2, 2022, the contents of which are incorporated herein by way of reference.

TECHNICAL FIELD

The present invention relates to a straddle-type vehicle including an internal combustion engine as an engine.

BACKGROUND

In general, straddle-type vehicles include those designed to be suitable for on-road traveling, that is, traveling on a paved road and a regular road, and those designed to be suitable not only for on-road traveling but also for off-road traveling, that is, traveling on an unpaved road or an irregular road. Straddle-type vehicles designed to be suitable for on-road traveling include a naked vehicle, a super sports vehicle, a cruiser vehicle, and the like. Straddle-type vehicles designed to be suitable for both on-road traveling and off-road traveling include a dual-purpose vehicle, an adventure vehicle, an on/off model vehicle, a scrambler vehicle, and the like. Some straddle-type vehicles are designed for off-road racing such as motocross, trial, and enduro.

Hereinafter, a straddle-type vehicle designed to be suitable for on-road traveling will be referred to as an "on-road vehicle". A straddle-type vehicle designed to be suitable for both on-road traveling and off-road traveling and a straddle-type vehicle designed for off-road racing will be referred to as an "off-road vehicle".

An off-road vehicle has a higher minimum ride height and a longer suspension stroke than an on-road vehicle. In many off-road vehicles, an exhaust pipe and a muffler are disposed at high positions away from the ground in the vehicle.

Here, regarding the arrangement of the exhaust pipes, an on-road vehicle and an off-road vehicle will be compared in detail. Generally, an exhaust pipe of an on-road vehicle extends downward from an exhaust port opened in a front surface of a cylinder head of an engine through a front side of each of the cylinder head, a cylinder, and a crankcase of the engine, bends backward, and then extends backward in a substantially horizontal direction at least to a position beyond the crankcase through a lower side of the crankcase (between the ground and a bottom surface of the crankcase). On the other hand, an exhaust pipe of an off-road vehicle (in particular, a straddle-type vehicle for off-road racing) once extends downward from an exhaust port opened in a front surface of a cylinder head through a front side of the cylinder head, but immediately bends laterally, then bends backward, and then extends backward in a substantially horizontal direction at least to a position beyond a cylinder or the cylinder head through a lateral side of the cylinder head or the cylinder. A significant difference in the arrangement of an exhaust pipe between an on-road vehicle and an off-road vehicle is that the exhaust pipe of the on-road vehicle passes below a crankcase, whereas the exhaust pipe of the off-road vehicle passes through a lateral side of a cylinder head or a cylinder. When traveling on an off-road, stones and the like on the ground are frequently wound up by wheels and scattered. By disposing an exhaust pipe at a high position away from the ground, it is possible to make it difficult for such flying stones to hit the exhaust pipe, and thus it is possible to protect the exhaust pipe. From this point of view, in many off-road vehicles, an exhaust pipe is disposed so as to pass through a lateral side of a cylinder head or a cylinder without passing below the crankcase.

On the other hand, in order to preserve the global environment, it is required to suppress discharge of air pollutants such as nitrogen oxides from an engine. Accordingly, a straddle-type vehicle includes a catalyst device in which a catalyst is supported on a monolith carrier having a honeycomb structure, for example, and the catalyst device is used to reduce air pollutants in exhaust gas.

In a straddle-type vehicle in the related art, in many cases, a catalyst device is provided in a muffler or in a portion of a back portion (downstream side) of an exhaust pipe that is close to the muffler. However, in recent years, there have been an increasing number of straddle-type vehicles in which a catalyst device is provided in a front portion (upstream side) of an exhaust pipe.

A temperature of a catalyst of the catalyst device is increased and the catalyst is activated by the exhaust gas discharged from an engine flowing through the catalyst device. When the catalyst device is provided at a position far away from an exhaust port of the engine, such as inside the muffler, a temperature of the exhaust gas is decreased during a period in which the exhaust gas is discharged from the exhaust port of the engine, flows through the exhaust pipe, and reaches the catalyst device, and as a result, the exhaust gas having a low temperature flows through the catalyst device. Therefore, the increase in the temperature of the catalyst becomes gentle, and therefore, the time from the start of the engine to the activation of the catalyst becomes long. As a result, when the engine is started, an amount of air pollutants may not be sufficiently reduced by the catalyst. On the other hand, when the catalyst device is provided in the front portion of the exhaust pipe, a distance between the catalyst device and the exhaust port of the engine is shortened. Therefore, since the exhaust gas having a high temperature immediately after being discharged from the exhaust port flows through the inside of the catalyst device, the temperature of the catalyst can be increased within a short period of time, and the catalyst can be activated at an early stage when the engine is started. As a result, even when the engine is started, the amount of air pollutants can be sufficiently reduced by the catalyst. In recent years, with an increasing demand for global environmental preservation, the spread of straddle-type vehicles in which a catalyst device is provided in a front portion of an exhaust pipe expands in order to enhance exhaust gas purification performance of a catalyst when the engine is started.

JP2008-64068A (Patent Literature 1) describes a straddle-type vehicle which is an off-road vehicle. In the straddle-type vehicle, an exhaust pipe extends forward from an exhaust port of an engine, then bends backward, then passes through a position to the right of the engine and above a crankcase of the engine, and extends backward. The straddle-type vehicle includes a main catalyst and a pre-catalyst, the main catalyst is disposed in a muffler, and the pre-catalyst is disposed in a portion of the exhaust pipe immediately after passing above the crankcase.

Patent Literature 1: JP2008-64068A

As described below, it is not easy to appropriately provide a catalyst device inside a front portion of an exhaust pipe in a straddle-type vehicle having a structure in which the exhaust pipe does not pass below an engine but passes through a lateral side of the engine, such as a lateral side of a cylinder or a cylinder head of the engine, as in the above off-road vehicle.

In the straddle-type vehicle having a structure in which an exhaust pipe passes a lateral side of an engine, the front portion of the exhaust pipe is a portion of the exhaust pipe from an exhaust port of the engine to the lateral side of the engine, and a portion of the exhaust pipe passing through the lateral side of the engine.

First, there is the following problem when a catalyst device is provided in the portion of the exhaust pipe from the exhaust port of the engine to the lateral side of the engine.

In the straddle-type vehicle having a structure in which an exhaust pipe does not pass below an engine but passes through a lateral side of the engine as in the off-road vehicle, the exhaust pipe once extends downward from the exhaust port opened in a front surface of the cylinder head through a front side of the cylinder head, but immediately bends laterally, then bends backward, and reaches the lateral side of the engine. Therefore, the portion of the exhaust pipe from the exhaust port of the engine to the lateral side of the engine has a short pipe length. Therefore, it is difficult to provide the catalyst device inside the portion.

Next, there is the following problem when a catalyst device is provided in a portion of an exhaust pipe passing through a lateral side of an engine.

In the straddle-type vehicle having a structure in which an exhaust pipe passes a lateral side of an engine, the exhaust pipe passes through the lateral side of the engine, and then passes through a position that is on an inner side of a leg of a rider seated on a seat and that is extremely close to the leg. For example, when the exhaust pipe passes through a right side of the engine, the exhaust pipe passes through the right side of the engine, and then passes through a position that is to the left of a knee or a calf of a right leg of a rider seated on a seat and that is extremely close to the knee or the calf. The straddle-type vehicle having a structure in which an exhaust pipe passes through a lateral side of an engine is generally provided with a heat shield plate for protecting legs of a rider from heat from the exhaust pipe. The heat shield plate is provided in a region between the leg of the rider and a portion of the exhaust pipe passing through the lateral side of the engine as well as a portion immediately after the portion so as to shield between the exhaust pipe and the leg of the rider.

When a diameter of the catalyst device is larger than a normal diameter of the exhaust pipe, a diameter of the portion of the exhaust pipe where the catalyst device is provided is larger than the normal diameter of the exhaust pipe (diameter of a portion of the exhaust pipe where the catalyst device is not provided). Therefore, when such a catalyst device is provided in the portion of the exhaust pipe passing through the lateral side of the engine, a portion of the exhaust pipe passing through the inner side of the leg of the rider may have a large diameter. In this case, since a portion between a right leg and a left leg of the rider seated on the seat is widened in the straddle-type vehicle, the rider needs to ride the straddle-type vehicle in a posture in which the legs are widened, and a riding posture of the rider is worsened. Worsening of the riding posture leads to deterioration of maneuverability of the straddle-type vehicle.

When a catalyst device having a diameter smaller than a normal diameter of an exhaust pipe is provided in the exhaust pipe, a diameter of a portion of the exhaust pipe where the catalyst device is provided may not be larger than the normal diameter of the exhaust pipe. However, by providing the catalyst device inside the exhaust pipe, the portion of the exhaust pipe in which the catalyst device is provided tends to have a higher temperature than a portion of the exhaust pipe in which the catalyst device is not provided. Therefore, even when the catalyst device having a diameter smaller than the normal diameter of the exhaust pipe is provided in the portion of the exhaust pipe passing through the lateral side of the engine, it is necessary to increase a distance between the exhaust pipe and the shield plate in order to protect the legs of the rider from the heat from the exhaust pipe, and as a result, there is a possibility that the riding posture of the rider is worsened as when the catalyst device having a diameter larger than the normal diameter of the exhaust pipe is provided in the portion of the exhaust pipe passing through the lateral side of the engine. Since the catalyst device having a diameter smaller than the normal diameter of the exhaust pipe has lower exhaust gas purification performance than the catalyst device having a diameter larger than the normal diameter of the exhaust pipe, the exhaust gas may not be sufficiently purified.

In the straddle-type vehicle described in JP2008-64068A (Patent Literature 1), the exhaust pipe passes through a lateral side of a cylinder or a cylinder head of an engine, and then extends backward through a center side of the straddle-type vehicle in a left-right direction with respect to the cylinder or the cylinder head of the engine. A catalyst device having a diameter larger than a normal diameter of the exhaust pipe is provided in a portion of the exhaust pipe extending backward through the central side of the straddle-type vehicle in the left-right direction with respect to the cylinder or the cylinder head of the engine (see FIG. 3 of the same publication). According to this configuration, by providing the catalyst device inside the exhaust pipe, it may be possible to suppress a portion of the straddle-type vehicle between a right leg and a left leg of a rider seated on a seat from becoming wide to some extent even when a portion of the exhaust pipe passing through an inner side of the leg of the rider has a large diameter. However, in a case of this configuration, it is necessary to expand a space surrounded by a main frame, a rear cushion, and the cylinder of the engine in order to pass the exhaust pipe to the central side of the straddle-type vehicle in the left-right direction, the exhaust pipe having a large diameter by providing the catalyst device, and as a result, the straddle-type vehicle may be increased in size.

The present invention is made in view of, for example, the above problem, and an object of the present invention is to appropriately provide a catalyst device in a front portion of an exhaust pipe in a straddle-type vehicle having a structure in which the exhaust pipe does not pass below an engine but passes through a lateral side of the engine.

SUMMARY

There is provided a straddle-type vehicle including: a head pipe; a main frame extending backward from the head pipe; a down frame extending downward from the head pipe; an engine including a crankcase, a cylinder provided above the crankcase, and a cylinder head provided above the cylinder, the engine being disposed below the main frame and behind the down frame; a muffler disposed behind the engine and configured to reduce exhaust noise of exhaust gas that is discharged from an exhaust port provided in the cylinder head; an exhaust pipe configured to connect the exhaust port and the muffler and to send the exhaust gas discharged from the exhaust port to the muffler; and a catalyst device provided in an intermediate portion of the exhaust pipe and configured to purify the exhaust gas flowing through the exhaust pipe. The exhaust port is disposed in a front portion of the cylinder head, and is opened forward while being inclined to one side in a left-right direction. The exhaust pipe includes a first portion extending downward from the exhaust port through a region in front of the engine and on one lateral side of the down frame in the left-right direction, a second portion extending upward through a region in front of the engine and on the other lateral side of the down frame in the left-right direction after extending from a downstream side end portion of the first portion to the other lateral side of the down frame in the left-right direction through a region in front of or to the lower front of the down frame, a third portion extending backward from a downstream side end portion of the second portion through a region on the other lateral side of the engine in the left-right direction, and a fourth portion extending from a downstream side end portion of the third portion and reaching the muffler.

The catalyst device is disposed in a portion of the second portion of the exhaust pipe that is located in front of the engine and on the other lateral side of the down frame in the left-right direction.

DESCRIPTION OF EMBODIMENTS

Figure 1:
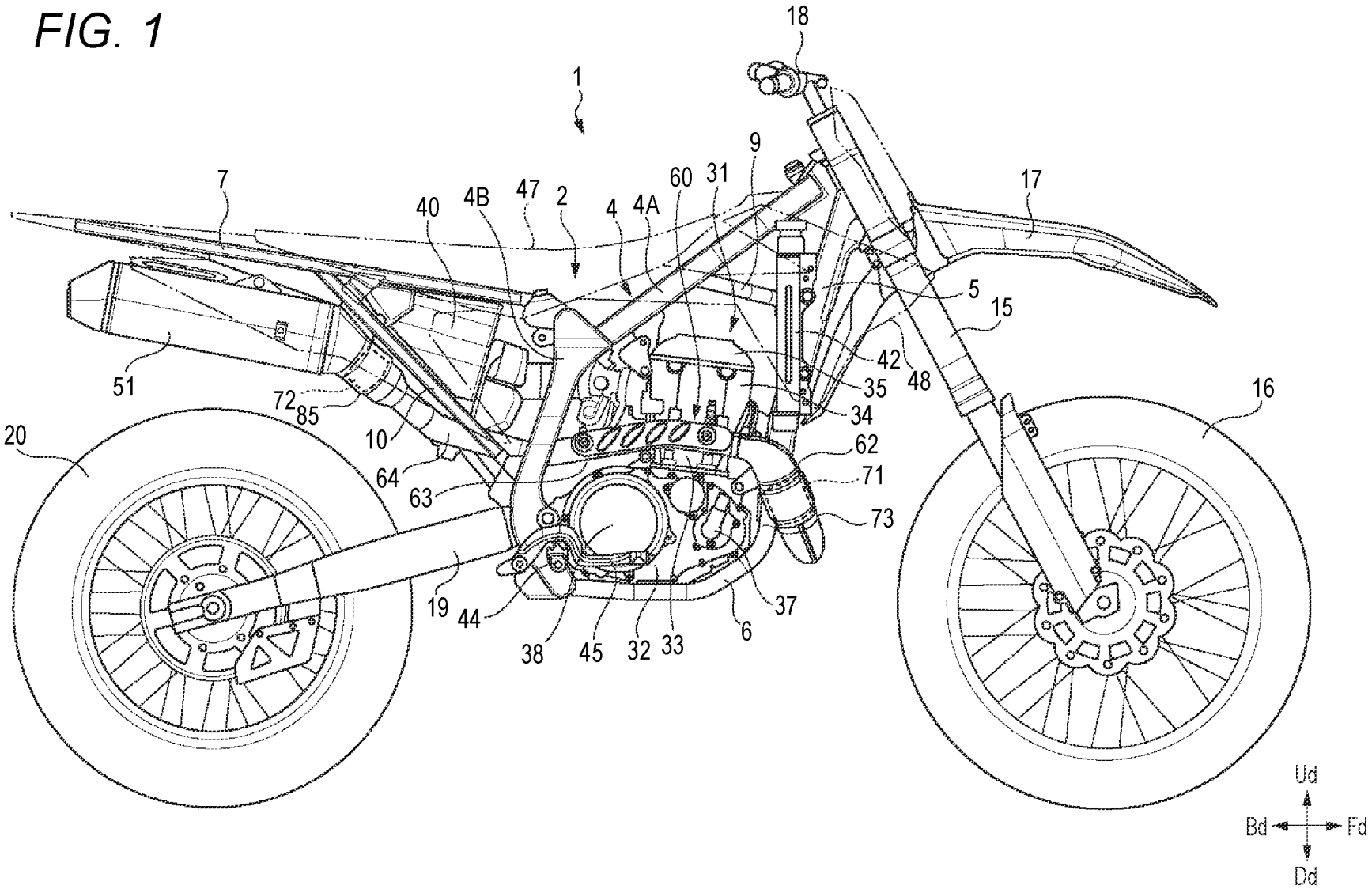
FIG. 1 is an external view of an entire straddle-type vehicle according to an embodiment of the present invention as viewed from the right.

A straddle-type vehicle according to an embodiment of the present invention includes a head pipe, a main frame extending backward from the head pipe, a down frame extending downward from the head pipe, and an engine disposed below the main frame and behind the down frame. The engine includes a crankcase, a cylinder provided above the crankcase, and a cylinder head provided above the cylinder. Further, the straddle-type vehicle according to the embodiment of the present invention includes a muffler that reduces exhaust noise of exhaust gas discharged from an exhaust port of the engine, an exhaust pipe that sends the exhaust gas discharged from the exhaust port of the engine to the muffler, and a catalyst device that purifies the exhaust gas flowing through the exhaust pipe.

In the straddle-type vehicle according to the embodiment of the present invention, the exhaust port of the engine is disposed in a front portion of the cylinder head, and is opened forward while being inclined to one side in a left-right direction. The muffler is disposed behind the engine. The exhaust pipe connects the exhaust port of the engine and the muffler. The exhaust pipe includes a first portion extending downward from the exhaust port of the engine through a region in front of the engine and on one lateral side of the down frame in the left-right direction, a second portion extending upward through a region in front of the engine and on the other lateral side of the down frame in the left-right direction after extending from a downstream side end portion of the first portion to the other lateral side of the down frame in the left-right direction through a region in front of or to the lower front of the down frame, a third portion extending backward from a downstream side end portion of the second portion through a region on the other lateral side of the engine in the left-right direction, and a fourth portion extending from a downstream side end portion of the third portion to reach the muffler. The catalyst device is provided in the intermediate portion of the exhaust pipe. Specifically, the catalyst device is disposed in a portion of the second portion of the exhaust pipe that is located in front of the engine and on the other lateral side of the down frame in the left-right direction.

According to the straddle-type vehicle according to the embodiment of the present invention, the catalyst device can be appropriately provided in a front portion (upstream side) of the exhaust pipe.

That is, as described above, since a pipe length of a portion of an exhaust pipe from an exhaust port of an engine to a lateral side of the engine is short in a straddle-type vehicle in the related art having a structure in which the exhaust pipe passes through the lateral side of the engine, there is a problem that it is difficult to provide a catalyst device in this portion. However, the exhaust pipe of the straddle-type vehicle according to the present embodiment includes the first portion extending downward from the exhaust port of the engine through the region in front of the engine and on one lateral side of the down frame in the left-right direction, and the second portion extending upward through the region in front of the engine and on the other lateral side of the down frame in the left-right direction after extending from the downstream side end portion of the first portion to the other lateral side of the down frame in the left-right direction through the region in front of or to the lower front of the down frame. According to this configuration, it is possible to secure a pipe length sufficient for providing a catalyst device in a portion of the exhaust pipe that is located in front of the engine and on the other lateral side of the down frame in the left-right direction, and it is possible to easily provide the catalyst device in this portion. In particular, a large-sized catalyst device having a diameter larger than a normal diameter of an exhaust pipe and having high exhaust gas purification performance can be easily provided at the portion of the exhaust pipe that is located in front of the engine and on the other lateral side of the down frame in the left-right direction.

As described above, when a catalyst device having a diameter larger than a normal diameter of an exhaust pipe is provided in a portion of the exhaust pipe passing through a lateral side of an engine in the straddle-type vehicle in the related art having the structure in which the exhaust pipe passes through the lateral side of the engine, a portion between a right leg and a left leg of a rider seated on a seat becomes wide in the straddle-type vehicle, and thus there is a problem that a riding posture of the rider is worsened. Even when a catalyst device having a diameter smaller than the normal diameter of the exhaust pipe is provided in the portion of the exhaust pipe passing through the lateral side of the engine, it is necessary to increase a distance between the exhaust pipe and a shield plate in order to protect the legs of the rider from heat from the exhaust pipe, and thus there is a problem that the riding posture of the rider may be worsened. However, since the catalyst device is provided in the portion of the second portion of the exhaust pipe that is located in front of the engine and on the other lateral side of the down frame in the left-right direction in the straddle-type vehicle according to the present embodiment, such a problem does not occur. That is, according to the straddle-type vehicle according to the present embodiment, it is possible to suppress the riding posture of the rider from worsening due to provision of the catalyst device inside the front portion of the exhaust pipe.

As described above, in the straddle-type vehicle described in JP2008-64068A (Patent Literature 1), a catalyst device having a diameter larger than a normal diameter of an exhaust pipe is provided in a portion of the exhaust pipe extending backward from a cylinder or a cylinder head of an engine through a center side of the straddle-type vehicle in a left-right direction, whereby it is necessary to expand a space surrounded by a main frame, a rear cushion, the cylinder of the engine, and the like, and as a result, there is a problem that the straddle-type vehicle may be increased in size. However, since the catalyst device of the straddle-type vehicle according to the present embodiment is disposed in the portion of the second portion of the exhaust pipe that is located in front of the engine and on the other lateral side of the down frame in the left-right direction, such a problem does not occur.

In the straddle-type vehicle according to the present embodiment, the exhaust port of the engine is disposed in the front portion of the cylinder head, and is opened forward while being inclined to one side in the left-right direction. Accordingly, the exhaust pipe can be easily connected to the exhaust port without providing a locally bent portion with a large curvature at an upstream end side portion (first portion) of the exhaust pipe. The exhaust pipe can extend from the exhaust port to a position in front of or to the lower front of the down frame without providing a complicated bent portion such as an S-shaped or crank-shaped bent portion at the upstream end side portion (first portion) of the exhaust pipe.

Embodiment

An embodiment of a straddle-type vehicle according to the present invention will be described with reference to the drawings. In the following embodiment, directions including front (Fd), back (Bd), up (Ud), down (Dd), left (Ld), and right (Rd) are described based on arrows drawn at the lower right in each drawing.

Straddle-Type Vehicle

Figure 2:
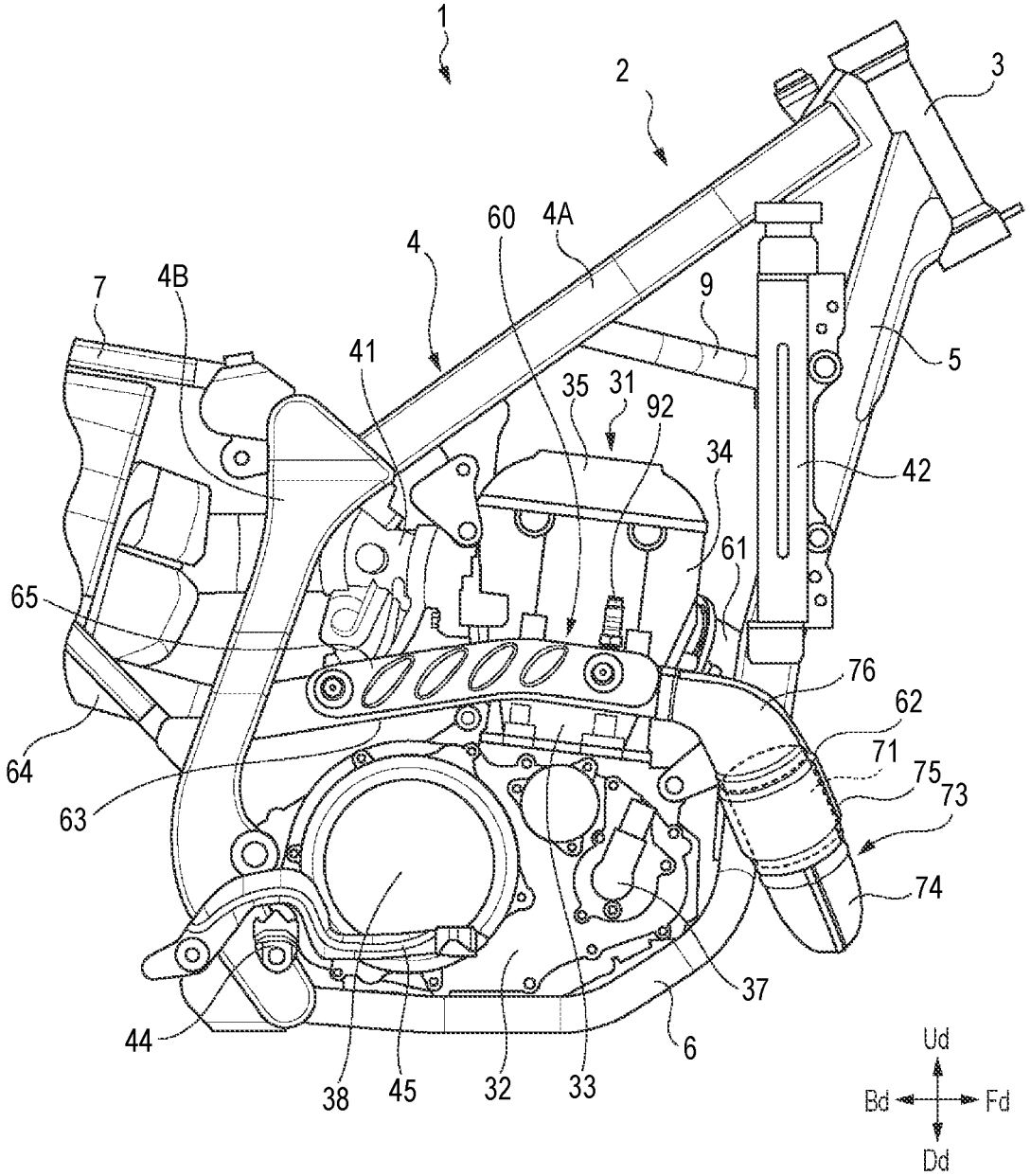
FIG. 2 is an external view of a portion of the straddle-type vehicle according to the embodiment of the present invention where an engine is provided, as viewed from the right.
Figure 3:
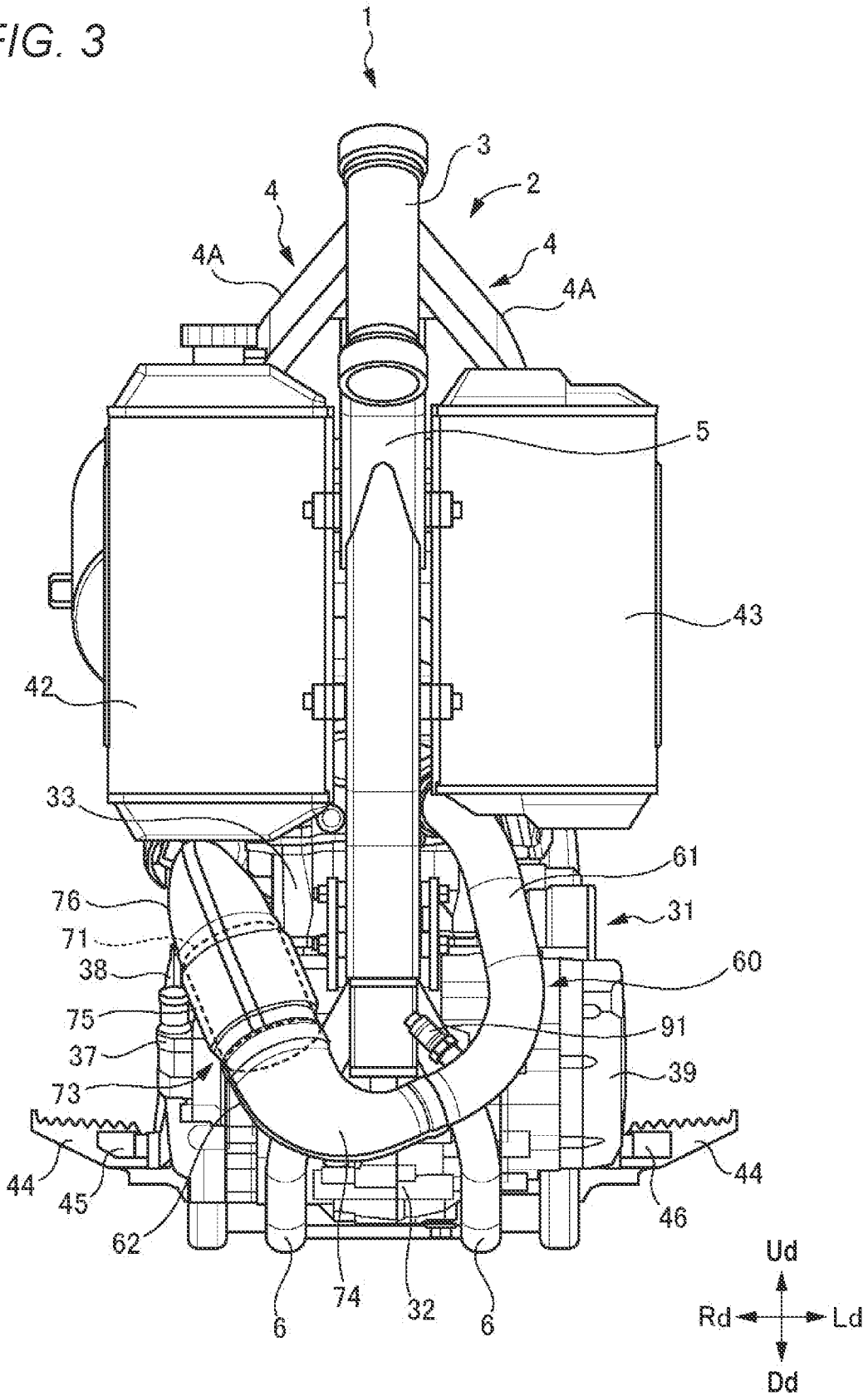
FIG. 3 is an external view of the portion of the straddle-type vehicle according to the embodiment of the present invention where an engine is provided, as viewed from the front.
Figure 4:
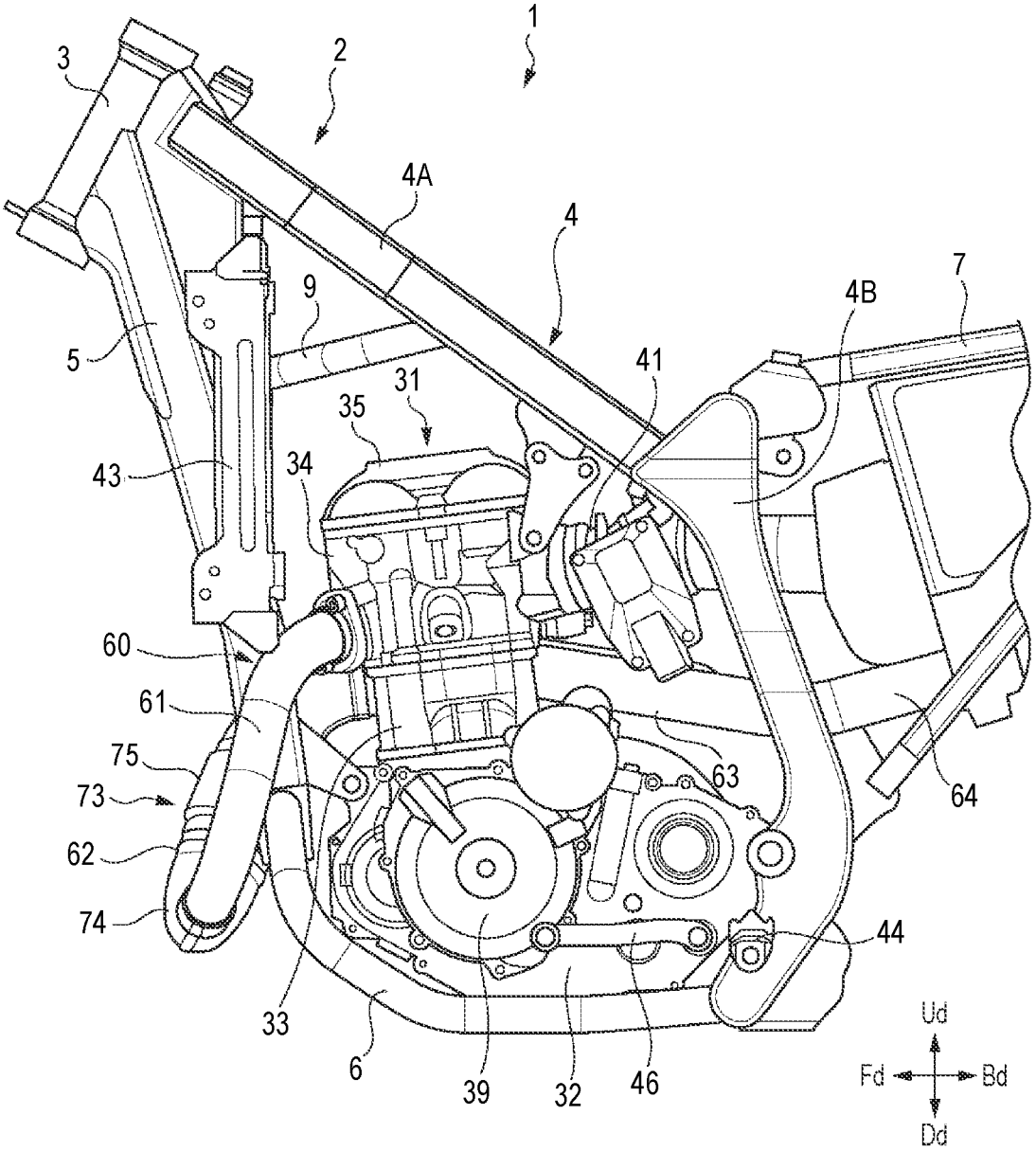
FIG. 4 is an external view of the portion of the straddle-type vehicle according to the embodiment of the present invention where an engine is provided, as viewed from the left.
Figure 5:
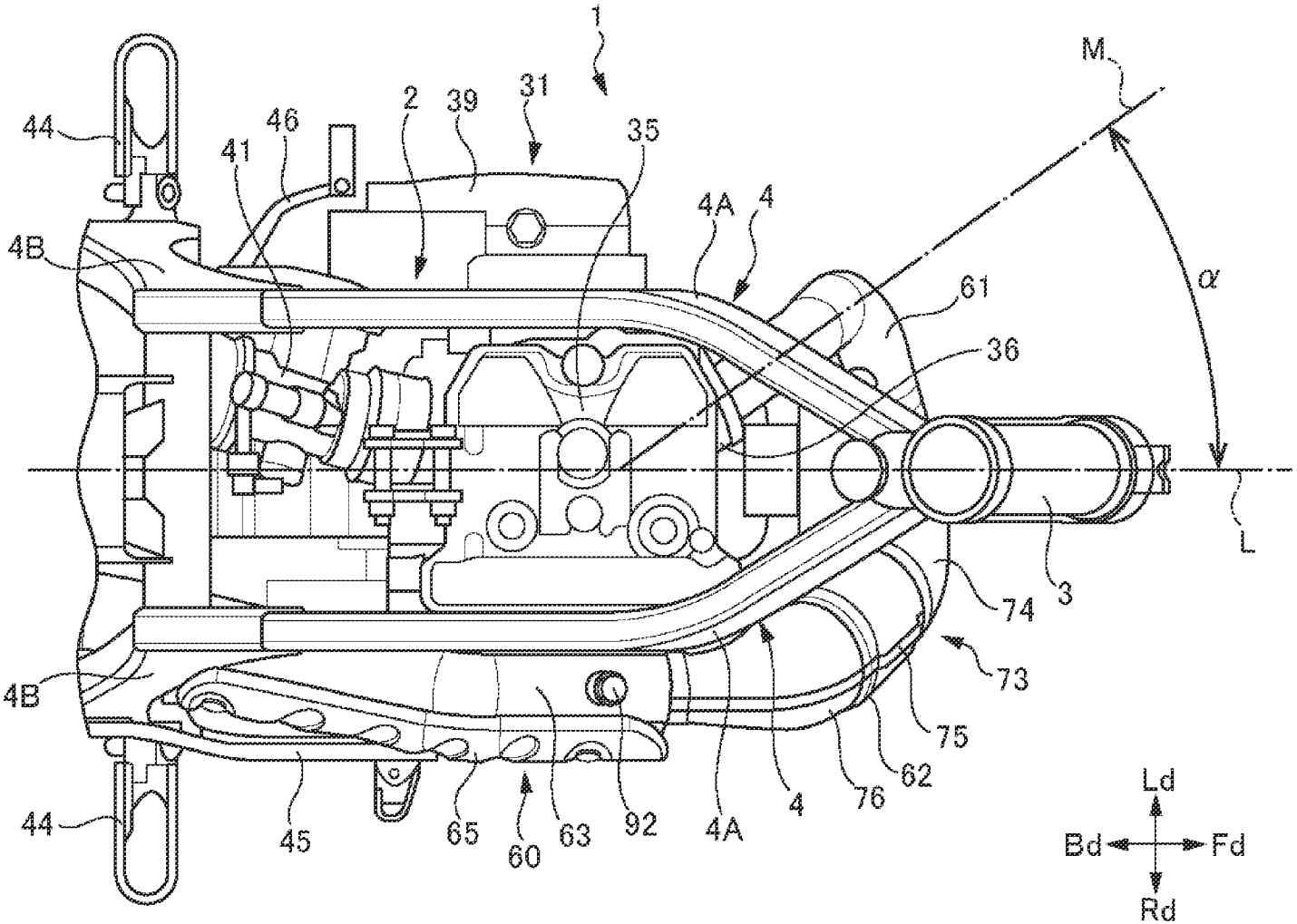
FIG. 5 is an external view of the portion of the straddle-type vehicle according to the embodiment of the present invention where an engine is provided, as viewed from above.
Figure 6:
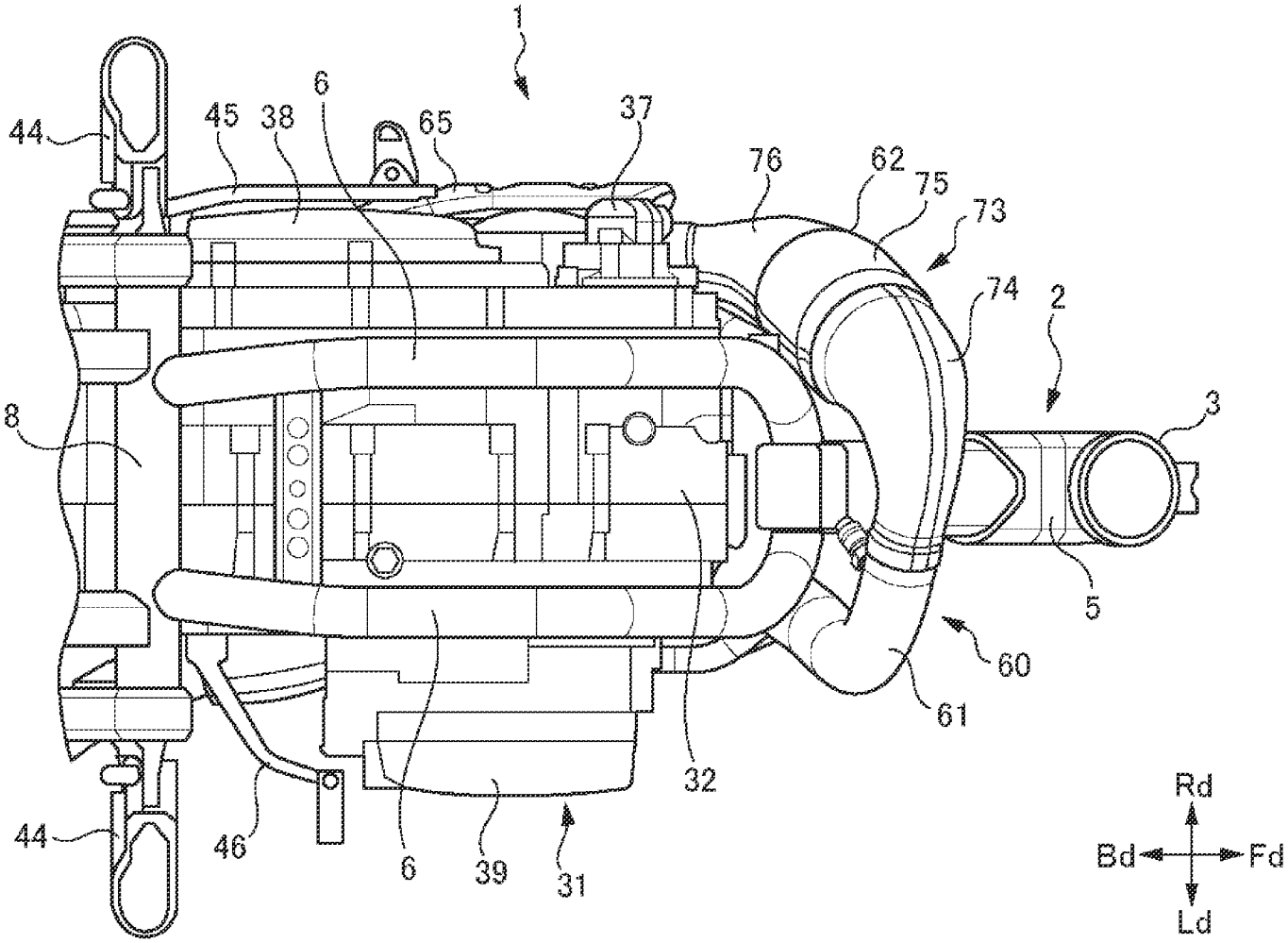
FIG. 6 is an external view of the portion of the straddle-type vehicle according to the embodiment of the present invention where an engine is provided, as viewed from below.

FIG. 1 shows an entire straddle-type vehicle 1 according to the embodiment of the present invention as viewed from the right. In FIG. 1, only outer shapes of a seat and a cowl are indicated by two-dot chain lines, and some components provided in the straddle-type vehicle 1, such as a fuel tank, a brake caliper, a rear cushion, and a drive chain, are not shown. FIGS. 2 to 6 show a portion where an engine 31 is provided in the straddle-type vehicle 1, and specifically, FIG. 2 shows a state where the portion is viewed from the right, FIG. 3 shows a state where the portion is viewed from the front, FIG. 4 shows a state where the portion is viewed from the left, FIG. 5 shows a state where the portion is viewed from above, and FIG. 6 shows a state where the portion is viewed from below. In FIGS. 2 to 6, a steering shaft, a front fork 15, a handle 18, a swing arm 19, and the like are removed. In FIGS. 5 and 6, radiators 42 and 43 are further removed.

In FIG. 1, the straddle-type vehicle 1 is an off-road vehicle, specifically, a straddle-type vehicle for off-road racing. The straddle-type vehicle 1 includes a vehicle body frame 2 that forms a framework thereof, and the vehicle body frame 2 includes a head pipe 3, a pair of main frames 4, a down frame 5, a pair of under frames 6, and a pair of seat rails 7.

As shown in FIGS. 2 and 3, the head pipe 3 is disposed at the center of a front upper portion of the straddle-type vehicle 1 in a left-right direction.

Of the pair of main frames 4, one main frame 4 extends from the front upper portion of the straddle-type vehicle 1 to a lower portion of an intermediate portion of the straddle-type vehicle 1 in a front-back direction through a right portion of the straddle-type vehicle 1. Specifically, as shown in FIG. 5, a front portion 4A of the one main frame 4 extends rightward and backward from the head pipe 3, then gently bends, and then extends backward. As shown in FIG. 2, the front portion 4A of the one main frame 4 extends backward through an upper right portion of the straddle-type vehicle 1 while being inclined downward. As shown in FIG. 2, a back portion 4B of the one main frame 4 extends downward through a right portion of the intermediate portion of the straddle-type vehicle 1 in the front-back direction while being slightly inclined backward. The other main frame 4 extends from the front upper portion of the straddle-type vehicle 1 to the lower portion of the intermediate portion of the straddle-type vehicle 1 in the front-back direction through a left portion of the straddle-type vehicle 1. As shown in FIGS. 4 and 5, the shape and arrangement of the other main frame 4 are bilaterally symmetrical to the shape and arrangement of the one main frame 4. A front end portion of each main frame 4 is coupled to the head pipe 3.

As shown in FIGS. 2 and 3, the down frame 5 extends downward from the front upper portion of the straddle-type vehicle 1 to a front lower portion of the straddle-type vehicle 1 through a center of the straddle-type vehicle 1 in the left-right direction while being slightly inclined backward. An upper end portion of the down frame 5 is coupled to the head pipe 3. A position of a lower end of the down frame 5 is higher than a position of a lower end of the back portion 4B of the main frame 4.

Of the pair of under frames 6, one under frame 6 extends from the front lower portion of the straddle-type vehicle 1 to the lower portion of the intermediate portion of the straddle-type vehicle 1 in the front-back direction through the right portion of the straddle-type vehicle 1. Specifically, as shown in FIGS. 3 and 6, the one under frame 6 extends downward, rightward, and backward from a lower end portion of the down frame 5, gently bends, and then extends backward in a substantially horizontal direction through a lower right portion of the straddle-type vehicle 1 as shown in FIG. 2. The other under frame 6 extends from the front lower portion of the straddle-type vehicle 1 to the lower portion of the intermediate portion of the straddle-type vehicle 1 in the front-back direction through the left portion of the straddle-type vehicle 1. As shown in FIGS. 3, 4, and 6, the shape and arrangement of the other under frame 6 are bilaterally symmetrical to the shape and arrangement of the one under frame 6. A front end portion of each under frame 6 is coupled to the lower end portion of the down frame 5. As shown in FIG. 6, a back end portion of each under frame 6 is coupled to a bridge frame 8 that is bridged between lower end portions of the back portions 4B of the pair of main frames 4.

As shown in FIGS. 1, 2, and 4, the pair of seat rails 7 extend from an upper portion of the intermediate portion of the straddle-type vehicle 1 in the front-back direction to an upper portion of a back end of the straddle-type vehicle 1 through the left and right portions of the straddle-type vehicle 1. A reinforcing frame 9 that reinforces a front portion of the vehicle body frame 2 is provided between the down frame 5 and each main frame 4 (see FIGS. 2 and 4), and a reinforcing frame 10 that reinforces a back portion of the vehicle body frame 2 is provided between the lower portion of the back portion 4B of each main frame 4 and the seat rail 7 (see FIG. 1).

As shown in FIG. 1, the steering shaft is rotatably provided in the head pipe 3, and the front fork 15 is attached to the steering shaft via a bracket. A front wheel 16 is rotatably attached to a lower end portion of the front fork 15. A front fender 17 is provided above the front wheel 16. The handlebar 18 is provided above the head pipe 3, and the handlebar 18 is attached to the steering shaft via a bracket. The swing arm 19 is swingably attached to a lower side portion of the back portion 4B of each main frame 4, and a back wheel 20 is rotatably attached to a back end portion of the swing arm 19.

The straddle-type vehicle 1 includes an engine 31 which is a power source for traveling. An internal combustion engine is used as the engine 31. The engine 31 according to the present embodiment is a four-cycle, water-cooling, and single-cylinder gasoline engine. The engine 31 is disposed at a substantially central portion in the front-back direction and a substantially central portion in the left-right direction of the straddle-type vehicle. The engine 31 is surrounded by the pair of main frames 4, the down frame 5, and the pair of under frames 6. Specifically, the engine 31 is disposed below the front portions 4A of the pair of main frames 4, in front of the back portions 4B of the pair of main frames 4, behind the down frame 5, and above the pair of under frames 6. The engine 31 is supported by these frames via engine mounts.

As shown in FIG. 4, the engine 31 includes a crankcase 32, a cylinder 33, a cylinder head 34, and a cylinder head cover 35. The crankcase 32 is disposed at a lower portion of the engine 31, and a crankshaft is provided in the crankcase 32. The engine 31 is a so-called power unit integrated with a transmission, and a transmission device is provided at a back portion in the crankcase 32. The cylinder 33 is provided above the crankcase 32, and a piston is provided in the cylinder 33. The cylinder head 34 is provided above the cylinder 33. An intake port (not shown) through which an air-fuel mixture is sent to the cylinder 33 is formed in a back portion of the cylinder head 34. An exhaust port 36 through which combustion gas (exhaust gas) is discharged to the outside of the cylinder 33 is formed in a front portion of the cylinder head 34 (see FIG. 7). An intake valve, an exhaust valve, a camshaft, and the like are provided in the cylinder head 34, and a spark plug (not shown) and the like are attached to the cylinder head 34. The cylinder head cover 35 covers an upper portion of the cylinder head 34.

Figure 7:
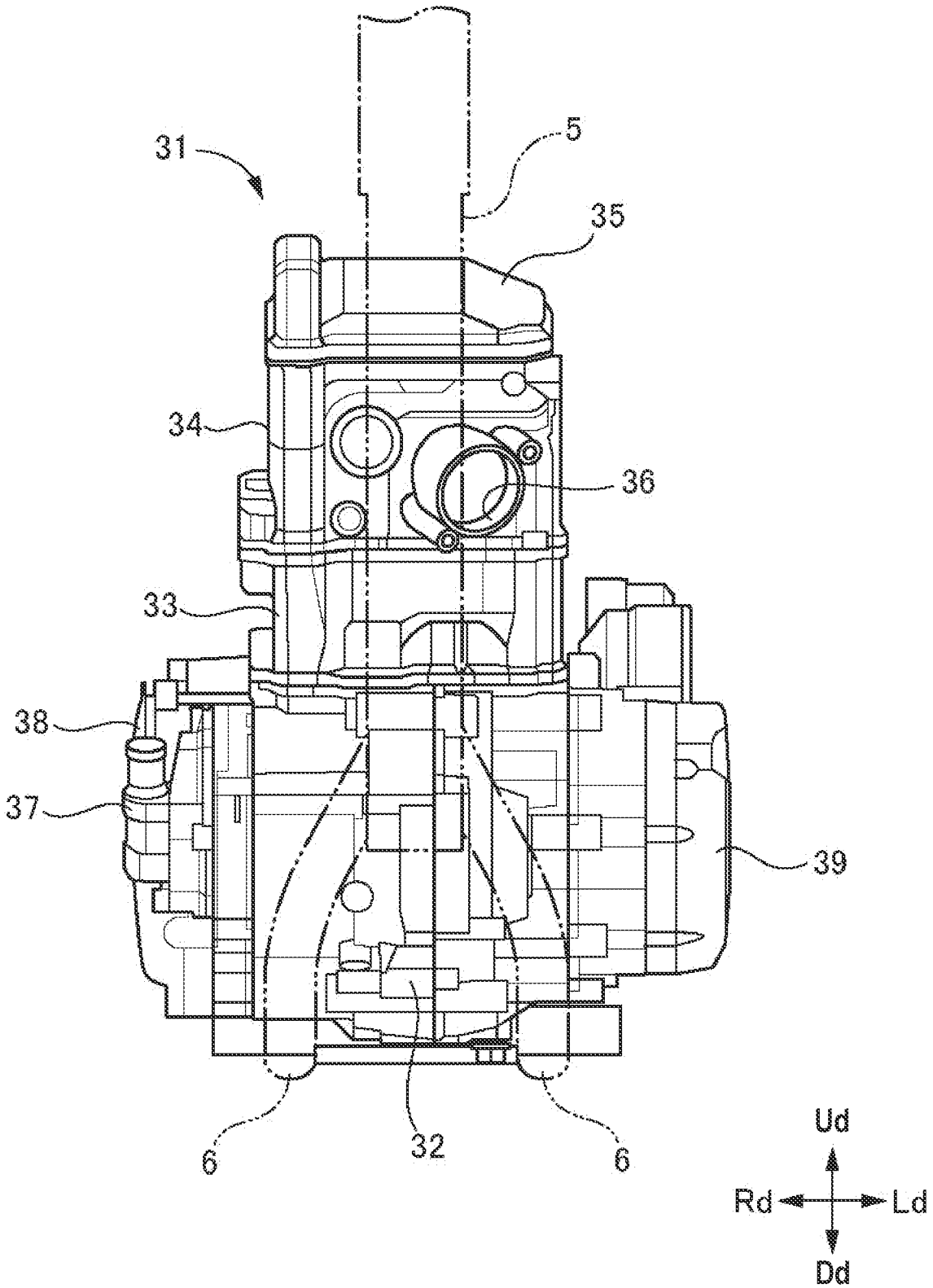
FIG. 7 is an external view of the engine of the straddle-type vehicle according to the embodiment of the present invention as viewed from the front.

FIG. 7 shows the engine 31 as viewed from the front. As shown in FIG. 7, the exhaust port 36 of the engine 31 is disposed on a front surface of the cylinder head 34 at a position to the left of the center of the cylinder head 34 in the left-right direction. In a front view of the straddle-type vehicle 1, only a part of a right end side of the exhaust port 36 overlaps with the down frame 5. The exhaust port 36 is opened forward in the front surface of the cylinder head 34 while being inclined to a left direction (one side in the left-right direction), that is, an opening direction of the exhaust port 36 is the left front. An one-dot chain line L in FIG. 5 is a straight line that passes through the center of the straddle-type vehicle 1 in the left-right direction and extends in the front-back direction. An one-dot chain line M in FIG. 5 is a straight line that passes through the center of the exhaust port 36 and extends in the opening direction of the exhaust port 36. An angle a formed by the one-dot chain line L and the one-dot chain line M indicates an inclination angle of the exhaust port 36 in the left direction. In the present embodiment, the exhaust port 36 is inclined to the left direction by about 36 degrees as shown in FIG. 5. The inclination angle of the exhaust port 36 in the left direction is not limited to 36 degrees, but is preferably about 20 degrees or more and about 70 degrees or less. A minimum value of the inclination angle of the exhaust port 36 at which an upstream side end portion of an exhaust pipe 60 can be easily connected to the exhaust port 36 from the left of the down frame 5 is about 20 degrees, and a maximum value of an angle at which a first portion 61 of the exhaust pipe 60 can be easily routed so as not to protrude leftward from the leftmost portion of the engine 31 (left surface of a magneto cover 39) is about 70 degrees.

As shown in FIG. 2, a water pump 37 that circulates cooling water mainly for cooling the engine 31 is provided on an outer surface side of a right front portion of the crankcase 32. A clutch is provided at a right back portion in the crankcase 32, and a clutch cover 38 that covers the clutch is provided at an outer surface side of the right back portion of the crankcase 32. As shown in FIG. 4, a generator that generates electric power using rotation of the crankshaft is provided at a left front portion in the crankcase 32, and the magneto cover 39 that covers the generator is provided on an outer surface side of the left front portion of the crankcase 32.

In the straddle-type vehicle 1, an air cleaner 40 is provided behind and above the engine 31 as shown in FIG. 1, and an intake pipe 41 is provided between the air cleaner 40 and the intake port of the engine 31 as shown in FIG. 4. Although not shown in detail, a throttle device, a fuel injector, and the like are provided around the intake port of the engine 31.

In the straddle-type vehicle 1, two radiators 42 and 43 are provided in front of the cylinder head 34 of the engine 31 as heat exchangers that mainly cool, by traveling wind, cooling water for cooling the engine 31. As shown in FIG. 3, the radiator 42 is disposed to the right of an upper portion of the down frame 5, and the radiator 43 is disposed to the left of the upper portion of the down frame 5. The radiators 42 and 43 are attached to the upper portion of the down frame 5 via radiator mounts, respectively.

A step 44 for a right foot and a brake pedal 45 are provided at the lower portion of the back portion 4B of the right main frame 4 (see FIG. 2). A step 44 for a left foot and a shift pedal 46 are provided at the lower portion of the back portion 4B of the left main frame 4 (see FIG. 4). A seat 47 on which a rider sits is provided at the upper portion of the intermediate portion of the straddle-type vehicle 1 in the front-back direction, and a cowl 48 is provided in front of and behind the seat 47 (see FIG. 1).

Exhaust Pipe and Muffler

The straddle-type vehicle 1 includes a muffler 51 that reduces exhaust noise of exhaust gas discharged from the exhaust port 36 of the engine 31, and the exhaust pipe 60 that sends the exhaust gas discharged from the exhaust port 36 to the muffler 51.

The muffler 51 is disposed behind the engine 31, specifically, behind the air cleaner 40 that is disposed behind the engine 31, as shown in FIG. 1. The muffler 51 is disposed between the right seat rail 7 and the back wheel 20 such that a discharge port through which exhaust gas is discharged to the outside air faces backward. The muffler 51 is supported by the right seat rail 7 via a stay.

The exhaust pipe 60 is a pipe that connects the muffler 51 and the exhaust port 36 formed in the cylinder head 34 of the engine 31, and is formed of a metal material such as steel. The exhaust pipe 60 includes the first portion 61 extending downward from the exhaust port 36 through a region in front of the engine 31 and to the left (one lateral side in the left-right direction) of the down frame 5 as shown in FIG. 4, a second portion 62 extending upward through a region in front of the engine 31 and to the right (the other lateral side in the left-right direction) of the down frame 5 after extending from a downstream side end portion of the first portion 61 to the right of the down frame 5 (the other lateral side in the left-right direction) through a region to the lower front of the down frame 5 as shown in FIG. 3, a third portion 63 extending backward from a downstream side end portion of the second portion 62 through a region to the right of the engine 31 as shown in FIG. 2, and a fourth portion 64 extending from a downstream side end portion of the third portion 63 to the muffler 51 as shown in FIG. 1.

Figure 8:
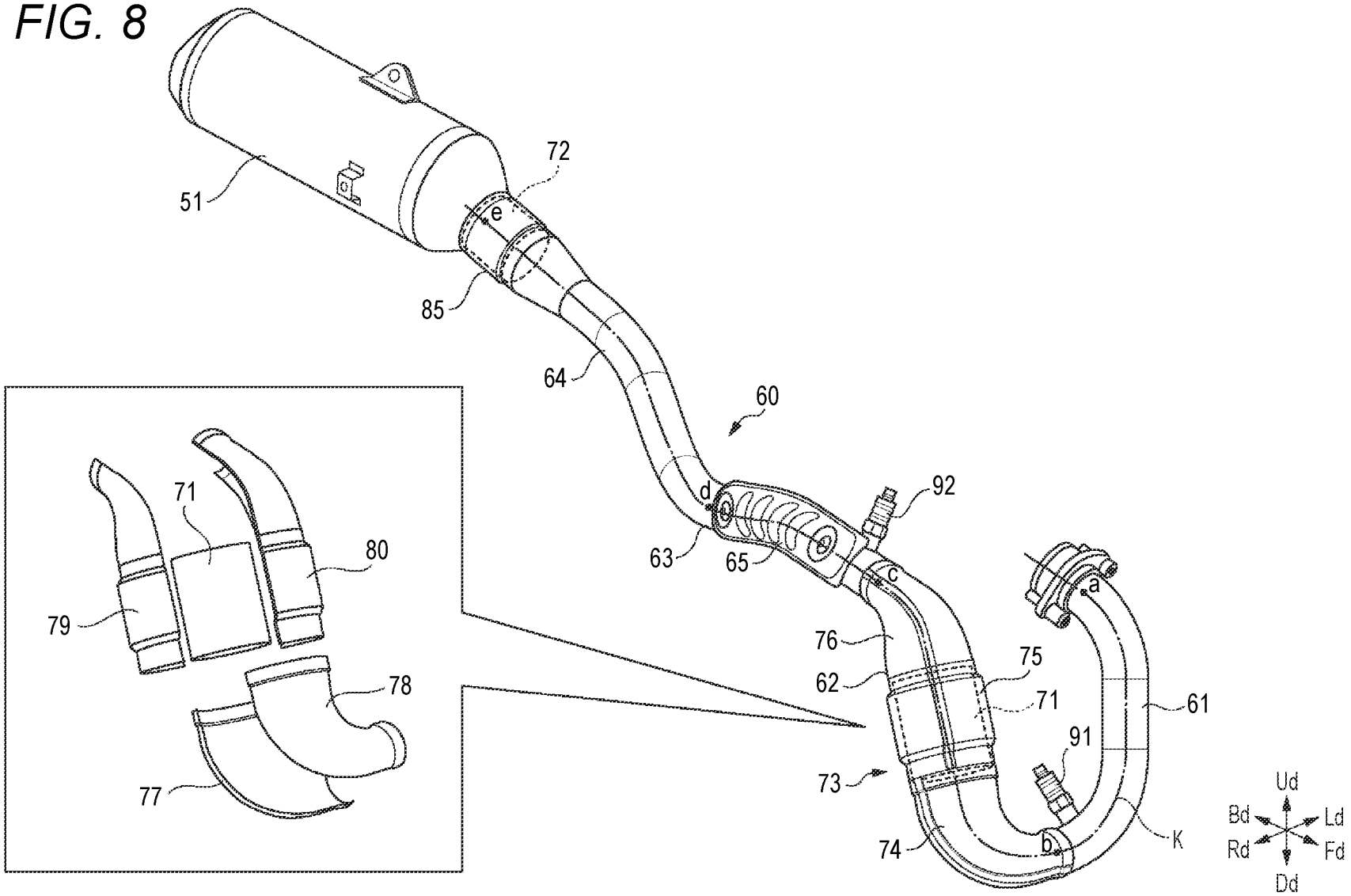
FIG. 8 is a view showing an exhaust pipe, a first catalyst device accommodating portion, a muffler, and the like of the straddle-type vehicle according to the embodiment of the present invention.

FIG. 8 is a view showing the exhaust pipe 60, the muffler 51, and the components provided at the exhaust pipe 60 extracted from the straddle-type vehicle 1. An one-dot chain line K in FIG. 8 is a line passing through the center of the exhaust pipe 60. In the exhaust pipe 60 in FIG. 8, a portion from a position a to a position b is the first portion 61, a portion from the position b to a position c is the second portion 62, a portion from the position c to a position d is the third portion 63, and a portion from the position d to a position e is the fourth portion 64.

Each part of the exhaust pipe 60 will be described in more detail. An upstream side end portion of the first portion 61 of the exhaust pipe 60 is connected to the exhaust port 36 that is opened leftward and forward at a position to the left of the front surface of the cylinder head 34. As shown in FIG. 3, the first portion 61 of the exhaust pipe 60 is located to the left of the down frame 5. In the front view of the straddle-type vehicle 1, the first portion 61 of the exhaust pipe 60 extends leftward and downward from the exhaust port 36 and then extends rightward and downward. In addition, in the front view of the straddle-type vehicle 1, the first portion 61 of the exhaust pipe 60 is gently curved so as to draw an arc-shaped locus bulging leftward with a diameter of a lower portion of the down frame 5 as a whole, and the upstream side end portion and the downstream side end portion of the first portion 61 of the exhaust pipe 60 are close to the down frame 5, whereas an intermediate portion of the first portion 61 of the exhaust pipe 60 is separated from the down frame 5. The downstream side end portion of the first portion 61 of the exhaust pipe 60 is located in front of the crankcase 32 and to the lower left front of the down frame 5. Specifically, the downstream side end portion of the first portion 61 of the exhaust pipe 60 is located to the lower left of the lower end of the down frame 5, and is located in front of an upper end side portion of the left under frame 6 in the front view of the straddle-type vehicle 1. As shown in FIG. 4, in a left side view of the straddle-type vehicle 1, the first portion 61 of the exhaust pipe 60 extends downward from the exhaust port 36 while being inclined forward, and the upstream side end portion of the first portion 61 of the exhaust pipe 60 is located behind the down frame 5, but the downstream side end portion of the first portion 61 of the exhaust pipe 60 is located in front of the down frame 5. As shown in FIG. 5, the intermediate portion of the first portion 61 of the exhaust pipe 60 protrudes leftward (outward in the left-right direction) from the left main frame 4, but is located to the right (inner side in the left-right direction) of the leftmost portion of the engine 31 (left surface of the magneto cover 39). The first portion 61 of the exhaust pipe 60 has a constant diameter over the entire length thereof. The first portion 61 of the exhaust pipe 60 is formed by bending a pipe.

As shown in FIG. 3, in the front view of the straddle-type vehicle 1, the second portion 62 of the exhaust pipe 60 extends rightward from the downstream side end portion of the first portion 61 of the exhaust pipe 60 that is located to the left of the down frame 5 through the lower front of the down frame 5, and then extends rightward and upward through the right of the lower portion of the down frame 5. An upstream side portion of the second portion 62 of the exhaust pipe 60 is gently curved so as to draw an arc, and an extension direction of the second portion 62 of the exhaust pipe 60 gradually changes from the right to the upper right due to the curve. The upstream side portion of the second portion 62 of the exhaust pipe 60 passes through a front side of the upper end side portion of the right under frame 6. As shown in FIG. 2, in a right side view of the straddle-type vehicle 1, an intermediate portion of the second portion 62 of the exhaust pipe 60 extends upward and backward through the right of the lower portion of the down frame 5, and a downstream side portion of the second portion 62 of the exhaust pipe 60 is curved so as to approach the horizontal. A portion of the second portion 62 of the exhaust pipe 60 from the intermediate portion to the downstream side portion extends in an up-down direction from a substantially intermediate position of the crankcase 32 to a position of a boundary between the cylinder 33 and the cylinder head 34 beyond a position of a boundary between the crankcase 32 and the cylinder 33. The portion of the second portion 62 of the exhaust pipe 60 from the intermediate portion to the downstream side portion extends in the front-back direction from a position in front of the down frame 5 to a position behind the down frame 5. As shown in FIG. 5, in a top view of the straddle-type vehicle 1, the portion of the second portion 62 of the exhaust pipe 60 from the intermediate portion to the downstream side portion is located to the right front (outer side) of the front portion 4A of the right main frame 4 and extends along the front portion 4A of the right main frame 4. As shown in FIG. 2, the position of the downstream side end portion of the second portion 62 of the exhaust pipe 60 in the up-down direction is substantially equal to the position of the boundary between the cylinder 33 and the cylinder head 34. The position of the downstream side end portion of the second portion 62 of the exhaust pipe 60 in the front-back direction is substantially equal to the position of a front surface of the cylinder 33. The position of the downstream side end portion of the second portion 62 of the exhaust pipe 60 in the left-right direction is, as shown in FIG. 3, to the right (outer side in the left-right direction) of the right surface of the cylinder 33 and to the right of a right surface of the cylinder head 34, and as shown in FIG. 5, to the right of the right main frame 4 and to the left (inner side in the left-right direction) of the rightmost portion of the engine 31 (rightmost portion of the water pump 37). As will be described later, the second portion 62 of the exhaust pipe 60 is provided with a first catalyst device accommodating portion 73.

As shown in FIG. 2, the third portion 63 of the exhaust pipe 60 extends backward in the substantially horizontal direction from the downstream side end portion of the second portion 62 of the exhaust pipe 60 through the right of the boundary portion between the cylinder 33 and the cylinder head 34. As shown in FIG. 5, an upstream side portion of the third portion 63 of the exhaust pipe 60 is located to the right of the front portion 4A of the right main frame 4, but a downstream side portion of the third portion 63 of the exhaust pipe 60 is slightly bent to the right (inner side in the left-right direction) from the vicinity beyond the cylinder 33 and extends backward through the left (inner side in the left-right direction) of the back portion 4B of the right main frame 4. The third portion 63 of the exhaust pipe 60 has a constant diameter over the entire length thereof. The diameter of the third portion 63 of the exhaust pipe 60 is substantially equal to the diameter of the first portion 61 of the exhaust pipe 60. The third portion 63 of the exhaust pipe 60 is formed of a pipe. A heat shield plate 65 that suppresses heat of the exhaust pipe 60 from being transmitted to the right leg of the rider is provided to the right of the third portion 63 of the exhaust pipe 60. The heat shield plate 65 covers an outer surface of a right portion of the third portion 63 over a wide range. The heat shield plate 65 is attached to the third portion 63 via a spacer or the like.

The fourth portion 64 of the exhaust pipe 60 extends backward below the right portion of the air cleaner 40 from the downstream side end portion of the third portion 63 of the exhaust pipe 60. An upstream side portion of the fourth portion 64 of the exhaust pipe 60 is formed integrally with the third portion 63 of the exhaust pipe 60, and a portion of the exhaust pipe 60 from the upstream side end portion of the third portion 63 to a substantially intermediate portion of the fourth portion 64 is formed by one pipe. As described later, a downstream side portion of the fourth portion 64 of the exhaust pipe 60 is provided with a second catalyst device accommodating portion 85. A downstream side end portion of the fourth portion 64 of the exhaust pipe 60 is connected to an inlet through which the exhaust gas flows in the muffler 51.

Catalyst Device and Catalyst Device Accommodating Portion

The straddle-type vehicle 1 includes two catalyst devices, that is, a first catalyst device 71 and a second catalyst device 72 that purify exhaust gas discharged from the exhaust port 36 of the engine 31 and flowing through the exhaust pipe 60. Each of the first catalyst device 71 and the second catalyst device 72 is a three-way catalyst, and is formed by, for example, loading a catalyst on a monolith carrier having a honeycomb structure. The first catalyst device 71 has a columnar outer shape, and a diameter thereof is larger than a diameter of the first portion 61 of the exhaust pipe 60 and larger than a diameter of the third portion 63 of the exhaust pipe 60. The second catalyst device 72 has a columnar outer shape, and a diameter thereof is larger than a diameter of the upstream side portion of the fourth portion 64 of the exhaust pipe 60.

The first catalyst device 71 and the second catalyst device 72 are both provided in the intermediate portion of the exhaust pipe 60. Specifically, as shown in FIGS. 2 and 3, the first catalyst device 71 is provided in the second portion 62 of the exhaust pipe 60. More specifically, the first catalyst device 71 is provided in a portion of the second portion 62 of the exhaust pipe 60 that is located in front of the engine 31 and to the right of the down frame 5. The first catalyst device 71 is disposed at a position higher than the lower end of the down frame 5 and lower than the exhaust port 36 of the engine 31. The first catalyst device 71 is disposed above the under frame 6. On the other hand, as shown in FIG. 1, the second catalyst device 72 is provided in the downstream side portion of the fourth portion 64 of the exhaust pipe 60. The first catalyst device 71 is a specific example of a "catalyst device" in the claims.

The second portion 62 of the exhaust pipe 60 is provided with the first catalyst device accommodating portion 73 that accommodates the first catalyst device 71. As shown in FIGS. 2 and 3, the first catalyst device accommodating portion 73 includes a cylindrical enlarged diameter portion 74 whose diameter increases from the upstream side toward the downstream side of the second portion 62 of the exhaust pipe 60, a cylindrical large diameter portion 75 connected to a downstream side end portion of the enlarged diameter portion 74, and a cylindrical reduced diameter portion 76 which is connected to a downstream side end portion of the large diameter portion 75 and whose diameter decreases from the upstream side toward the downstream side of the second portion 62 of the exhaust pipe 60. In the present embodiment, the entire second portion 62 serves as the first catalyst device accommodating portion 73. That is, the upstream side portion of the second portion 62 of the exhaust pipe 60 is the enlarged diameter portion 74, the intermediate portion of the second portion 62 of the exhaust pipe 60 is the large diameter portion 75, and the downstream side portion of the second portion 62 of the exhaust pipe 60 is the reduced diameter portion 76. The first catalyst device accommodating portion 73 is a specific example of a "catalyst device accommodating portion" in the claims.

An upstream side end portion of the enlarged diameter portion 74 is connected to the downstream side end portion of the first portion 61 of the exhaust pipe 60. The third portion 63 of the exhaust pipe 60 is connected to a downstream side end portion of the reduced diameter portion 76. The first catalyst device 71 is disposed in the large diameter portion 75 such that an axis of the first catalyst device 71 coincides with an axis of the large diameter portion 75.

A diameter of the large diameter portion 75 is constant from an upstream side end portion to the downstream side end portion thereof. The diameter of the large diameter portion 75 is larger than the diameter of the first catalyst device 71. The diameter of the large diameter portion 75 is larger than the diameter of the first portion 61 of the exhaust pipe 60 and larger than the diameter of the third portion 63 of the exhaust pipe 60. For example, the diameter of the large diameter portion 75 is set to a value slightly larger than the diameter of the first catalyst device 71 so that the first catalyst device 71 can be accommodated and fixed in the large diameter portion 75. A diameter of the upstream side end portion of the enlarged diameter portion 74 is equal to the diameter of the first portion 61 of the exhaust pipe 60, and a diameter of the downstream side end portion of the enlarged diameter portion 74 is equal to the diameter of the large diameter portion 75. A diameter of an upstream side end portion of the reduced diameter portion 76 is equal to the diameter of the large diameter portion 75, and a diameter of the downstream side end portion of the reduced diameter portion 76 is equal to the diameter of the third portion 63 of the exhaust pipe 60.

The enlarged diameter portion 74 is increased in diameter and extends from a region in front of the crankcase 32 and to the lower front of the down frame 5 to a region in front of the crankcase 32 and to the right of the down frame 5 while being bent upward, rightward, and backward. That is, as shown in FIG. 3, the upstream side end portion of the enlarged diameter portion 74 is located in front of the crankcase 32 and to the lower left front of the down frame 5. Specifically, the upstream side end portion of the enlarged diameter portion 74 is located to the lower left of the lower end of the down frame 5, and is located in front of the upper end side portion of the left under frame 6 in the front view of the straddle-type vehicle 1. The enlarged diameter portion 74 is gradually increased in diameter while being gently curved so as to draw an arc. The enlarged diameter portion 74 passes through a front side of the upper end side portion of the right under frame 6. The downstream side end portion of the enlarged diameter portion 74 is located in front of the crankcase 32 and to the lower right front of the down frame 5.

The large diameter portion 75 linearly extends upward, rightward, and backward through a region in front of the crankcase 32 and to the right of the down frame 5. The large diameter portion 75 and the first catalyst device 71 in the large diameter portion 75 are located substantially just to the right of the lower end portion of the down frame 5. The large diameter portion 75 and the first catalyst device 71 in the large diameter portion 75 are located substantially directly below the right radiator 42.

The reduced diameter portion 76 is decreased in diameter and extends from a region in front of the crankcase 32 and to the right of the down frame 5 toward a region to the right of the cylinder 33 or the cylinder head 34 while being bent backward so as to be close to the horizontal direction. The reduced diameter portion 76 is gradually decreased in diameter while being gently curved so as to draw an arc. As shown in FIG. 2, a position of the downstream side end portion of the reduced diameter portion 76 in the up-down direction is substantially equal to the position of the boundary between the cylinder 33 and the cylinder head 34, and a position of the downstream side end portion of the reduced diameter portion 76 in the front-back direction is substantially equal to the position of the front surface of the cylinder 33. A position of the downstream side end portion of the reduced diameter portion 76 in the left-right direction is to the right (outer side in the left-right direction) of the right surface of the cylinder 33 and to the right of the right surface of the cylinder head 34 as shown in FIG. 3, and is to the right of the right main frame 4 as shown in FIG. 5.

When the first catalyst device accommodating portion 73 is viewed as a whole, the first catalyst device accommodating portion 73 is inclined such that the downstream side end portion of the reduced diameter portion 76 (downstream side end portion of the first catalyst device accommodating portion 73) is located above and behind the upstream side end portion of the enlarged diameter portion 74 (upstream side end portion of the first catalyst device accommodating portion 73). The first catalyst device accommodating portion 73 is inclined such that the downstream side end portion of the reduced diameter portion 76 is located above and to the right of the upstream side end portion of the enlarged diameter portion 74. That is, as shown in FIG. 2, the first catalyst device accommodating portion 73 extends from a position in front of the down frame 5 to a position behind the down frame 5 in the right side view of the straddle-type vehicle 1. The first catalyst device accommodating portion 73 extends from the substantially intermediate position of the crankcase 32 to the position of the boundary between the cylinder 33 and the cylinder head 34 beyond the position of the boundary between the crankcase 32 and the cylinder 33 in the right side view of the straddle-type vehicle 1. As shown in FIG. 3, the first catalyst device accommodating portion 73 extends from a position to the left of the down frame 5 to a position to the right of the down frame 5 in the front view of the straddle-type vehicle 1. As shown in FIG. 5, the first catalyst device accommodating portion 73 extends along the front portion 4A of the right main frame 4 through the outside of the front portion 4A of the right main frame 4 in the top view of the straddle-type vehicle 1.

In the present embodiment, the rightmost portion of the first catalyst device accommodating portion 73 is a right surface of an upstream side portion of the reduced diameter portion 76. As can be seen from FIGS. 3 and 6, the position of the rightmost portion of the first catalyst device accommodating portion 73 is located to the left of the rightmost portion of the engine 31 (rightmost portion of the water pump 37) and to the left of a right surface of the clutch cover 38. In the present embodiment, the lowermost portion of the first catalyst device accommodating portion 73 is a lower surface of the intermediate portion of the enlarged diameter portion 74. As can be seen from FIG. 2, a position of the lowermost portion of the first catalyst device accommodating portion 73 in the up-down direction is substantially equal to a position of the step 44 or a front end portion of the brake pedal 45 in the up-down direction.

The first catalyst device accommodating portion 73 is disposed below the right radiator 42 in a state of being inclined in the front-back direction such that the upstream side end portion of the enlarged diameter portion 74 is in front of a front surface of the right radiator 42 and the downstream side end portion of the reduced diameter portion 76 is behind a back surface of the right radiator 42. The rightmost portion of the first catalyst device accommodating portion 73 is located to the left of a right surface of the right radiator 42.

In a lower left portion of FIG. 8, a state in which the first catalyst device accommodating portion 73 is disassembled is shown. The first catalyst device accommodating portion 73 has a monaka structure, and is formed by coupling, for example, four metal plates 77 to 80 as shown in the lower left portion of FIG. 8. In the present embodiment, the enlarged diameter portion 74 is formed by welding the two press-formed metal plates 77 and 78 to each other, a structure in which the large diameter portion 75 and the reduced diameter portion 76 are integrated is formed by welding two press-formed metal plates 79 and 80 to each other, and the first catalyst device accommodating portion 73 is formed by welding the enlarged diameter portion 74 and the structure in which the large diameter portion 75 and the reduced diameter portion 76 are integrated to each other. The first catalyst device 71 is sandwiched between the two metal plates 79 and 80. For example, the upstream side end portion of the enlarged diameter portion 74 of the first catalyst device accommodating portion 73 is welded to the downstream side end portion of the first portion 61 of the exhaust pipe 60, and the downstream side end portion of the reduced diameter portion 76 of the first catalyst device accommodating portion 73 is welded to the upstream side end portion of the third portion 63 of the exhaust pipe 60.

The second catalyst device accommodating portion 85 is provided at the downstream side portion of the fourth portion 64 of the exhaust pipe 60. The second catalyst device accommodating portion 85 is formed in a cylindrical shape having a diameter larger than a diameter of the second catalyst device 72 and the diameter of the upstream side portion of the fourth portion 64 of the exhaust pipe 60. The second catalyst device 72 is provided in the second catalyst device accommodating portion 85.

In the exhaust pipe 60, a first exhaust gas sensor 91 is provided upstream of the first catalyst device 71, and a second exhaust gas sensor 92 is provided downstream of the first catalyst device 71. The first exhaust gas sensor 91 is a sensor that detects a state of the exhaust gas inside a portion of the exhaust pipe 60 upstream of the first catalyst device 71, and is, for example, an oxygen sensor. The second exhaust gas sensor 92 is a sensor that detects a state of exhaust gas inside a portion of the exhaust pipe 60 downstream of the first catalyst device 71, and is, for example, an oxygen sensor. The straddle-type vehicle 1 performs fuel injection control and the like based on detection signals output from the first exhaust gas sensor 91 and the second exhaust gas sensor 92, in order to increase the purification rate of the exhaust gas by the first catalyst device 71. The first exhaust gas sensor 91 is a specific example of an "exhaust gas sensor" in the claims.

The first exhaust gas sensor 91 is provided at a portion of the exhaust pipe 60 passing through a region in front of the down frame 5. Specifically, as shown in FIG. 3, the first exhaust gas sensor 91 is provided at a downstream side portion of the first portion 61 of the exhaust pipe 60, and protrudes upward, rightward, and backward from an upper surface of the downstream side portion of the first portion 61. The first exhaust gas sensor 91 is disposed such that the entire first exhaust gas sensor 91 overlaps with the first catalyst device accommodating portion 73 in the side view of the straddle-type vehicle 1. As shown in FIG. 2, the first exhaust gas sensor 91 is completely hidden by the first catalyst device accommodating portion 73 in the right side view of the straddle-type vehicle 1. The first exhaust gas sensor 91 is disposed such that the entire first exhaust gas sensor 91 overlaps with the first portion 61 of the exhaust pipe 60 in the side view of the straddle-type vehicle 1. As shown in FIG. 4, the first exhaust gas sensor 91 is completely hidden by the first portion 61 of the exhaust pipe 60 in the left side view of the straddle-type vehicle 1. As shown in FIG. 3, the first exhaust gas sensor 91 overlaps with the upper end side portion of the left under frame 6 in the front view of the straddle-type vehicle 1.

The second exhaust gas sensor 92 is provided at the upstream side portion of the third portion 63 of the exhaust pipe 60, and protrudes upward from an upper surface of the upstream side portion of the third portion 63. The second exhaust gas sensor 92 is located to the right of the cylinder head 34, and the entire second exhaust gas sensor 92 overlaps with the cylinder head 34 in the side view of the straddle-type vehicle 1.

As described above, in the straddle-type vehicle 1 according to the embodiment of the present invention, the exhaust pipe 60 includes the first portion 61 extending downward from the exhaust port 36 of the engine 31 through the region in front of the engine 31 and to the left of the down frame 5, the second portion 62 extending upward through the region in front of the engine 31 and to the right of the down frame 5 after extending from the downstream side end portion of the first portion 61 to the right of the down frame 5 through the region to the lower front of the down frame 5, the third portion 63 extending backward from the downstream side end portion of the second portion 62 through the region to the right of the engine 31, and the fourth portion 64 extending from the downstream side end portion of the third portion 63 and reaching the muffler 51, and the first catalyst device 71 is disposed in the portion of the second portion 62 of the exhaust pipe 60 that is located in front of the engine 31 and to the right of the down frame 5. Accordingly, the first catalyst device 71 can be appropriately provided in a front portion of the exhaust pipe 60.

That is, in a straddle-type vehicle in the related art having a structure in which an exhaust pipe passes through a lateral side of an engine, since a pipe length of a portion of the exhaust pipe from an exhaust port of the engine to the lateral side of the engine is short, there is a problem that it is difficult to provide a catalyst device in this portion. However, the exhaust pipe 60 of the straddle-type vehicle 1 according to the present embodiment includes the first portion 61 extending downward from the exhaust port 36 through the region in front of the engine 31 and to the left of the down frame 5, and the second portion 62 extending upward through the region in front of the engine 31 and to the right of the down frame 5 after extending from the downstream side end portion of the first portion 61 to the right of the down frame 5 through the region to the lower front of the down frame 5. With this configuration, it is possible to secure a sufficient pipe length for providing the first catalyst device 71 in a portion of the exhaust pipe 60 that is located in front of the engine 31 and to the right of the down frame 5, and it is possible to easily provide the first catalyst device 71 in this portion. In particular, the large-sized first catalyst device 71 having a diameter larger than the diameter of each of the first portion 61 and the third portion 63 of the exhaust pipe 60 and having high exhaust gas purification performance can be easily provided at the portion of the exhaust pipe 60 that is located in front of the engine 31 and to the right of the down frame 5.

More specifically, a path of the exhaust pipe 60 is a path from the left of the down frame 5 to the right of the down frame 5 through the lower front of the down frame 5, whereby the direction of the second portion 62 of the exhaust pipe 60 at the lower right of the down frame 5 can be brought close to a vertically upward direction in the front view of the straddle-type vehicle 1 without increasing a curvature of the curve of the upstream side portion of the second portion 62 of the exhaust pipe 60. Accordingly, the second portion 62 of the exhaust pipe 60 can be extended linearly for a long distance from the lower right of the down frame 5 to the front right of the cylinder 33 of the engine 31, and the downstream side end portion of the second portion 62 of the exhaust pipe 60 can be suppressed from protruding rightward from the rightmost portion of the engine 31. As a result, it is possible to provide the large diameter portion 75 extending linearly in a portion of the second portion 62 of the exhaust pipe 60 that extends linearly from the lower right of the down frame 5 to the front right of the cylinder 33, to accommodate the large-sized first catalyst device 71 having a large diameter and a certain length in an axial direction in the large diameter portion 75, and to dispose the first catalyst device accommodating portion 73 in which such a large-sized first catalyst device 71 is accommodated so as not to protrude from the rightmost portion of the engine 31 in the front view of the straddle-type vehicle 1.

In a straddle-type vehicle in the related art having a structure in which an exhaust pipe passes through a lateral side of an engine, when a catalyst device having a diameter larger than a normal diameter of the exhaust pipe is provided in a portion of the exhaust pipe passing through the lateral side of the engine, a portion of the straddle-ride type vehicle between a right leg and a left leg of a rider seated on a seat becomes wide, and thus there is a problem that a riding posture of the rider is worsened. Even when a catalyst device having a diameter smaller than the normal diameter of the exhaust pipe is provided in the portion of the exhaust pipe passing through the lateral side of the engine, it is necessary to increase a distance between the exhaust pipe and a shield plate in order to protect the legs of the rider from heat from the exhaust pipe, and thus there is a problem that the riding posture of the rider may be worsened. However, since the first catalyst device 71 is provided in the portion of the second portion 62 of the exhaust pipe 60 that is located in front of the engine 31 and to the right of the down frame 5 in the straddle-type vehicle 1 according to the present embodiment, such a problem does not occur. That is, according to the straddle-type vehicle 1 according to the present embodiment, it is possible to suppress the riding posture of the rider from worsening due to the provision of the first catalyst device 71 inside the front portion of the exhaust pipe 60.

As described above, in the straddle-type vehicle described in JP2008-64068A (Patent Literature 1), a catalyst device having a diameter larger than a normal diameter of an exhaust pipe is provided in a portion of the exhaust pipe extending backward through a center side of the straddle-type vehicle in the left-right direction with respect to a cylinder of an engine or a cylinder head, whereby it is necessary to expand a space surrounded by a main frame, a rear cushion, the cylinder of the engine, and the like, and as a result, there is a problem that the straddle-type vehicle may be increased in size. However, since the first catalyst device 71 of the straddle-type vehicle 1 according to the present embodiment is disposed in the portion of the second portion 62 of the exhaust pipe 60 that is located in front of the engine 31 and to the right of the down frame 5, such a problem does not occur.

In the straddle-type vehicle 1 according to the present embodiment, the exhaust port 36 of the engine 31 is disposed in the front portion of the cylinder head 34, and is opened forward while being inclined leftward. Accordingly, the exhaust pipe 60 can be easily connected to the exhaust port 36 without providing a locally bent portion with a large curvature at an upstream end side portion (first portion 61) of the exhaust pipe 60. The exhaust pipe 60 can extend from the exhaust port 36 to a position to the lower front of the down frame 5 without providing a complicated bent portion such as an S-shaped or crank-shaped bent portion at the upstream end side portion (first portion 61) of the exhaust pipe 60. When the exhaust port 36 of the engine 31 is opened forward without being inclined leftward or rightward, and the down frame 5 passes ahead in the opening direction of the exhaust port 36, it is necessary to secure an interval for disposing the upstream end side portion of the exhaust pipe 60 between the front portion of the engine 31 and the down frame 5. However, in the present embodiment, since the exhaust port 36 of the engine 31 is opened forward while being inclined leftward, the opening direction of the exhaust port 36 can be deviated from the down frame 5, and it is possible to dispose the upstream end side portion of the exhaust pipe 60 without securing such an interval. Therefore, the interval between the front portion of the engine 31 and the down frame 5 can be reduced, and the size of the straddle-type vehicle 1 can be reduced. In addition, since the exhaust port 36 of the engine 31 is opened forward while being inclined leftward, the first portion 61 of the exhaust pipe 60 can be suppressed from protruding leftward from the leftmost portion of the engine 31.

In the straddle-type vehicle 1 according to the present embodiment, the first catalyst device 71 is disposed, in front of the engine 31 and to the right of the down frame 5, at a position higher than the lower end of the down frame 5 and lower than the exhaust port 36 of the engine 31. Since the first catalyst device 71 is disposed at a position higher than the lower end of the down frame 5, the lowermost surface of the second portion 62 of the exhaust pipe 60 can be suppressed from being lowered. Therefore, even when the front wheel 16 moves in a direction approaching the front fender 17 caused by contraction of the front fork 15 due to the front wheel 16 moving over a large stone on the irregular ground or a step on the road, the front wheel 16 can be suppressed from coming into contact with the second portion 62 of the exhaust pipe 60. In addition, since the first catalyst device 71 is disposed at a position lower than the exhaust port 36 of the engine 31, the uppermost surface of the second portion 62 of the exhaust pipe 60 can be suppressed from becoming high, and the second portion 62 of the exhaust pipe 60 can be sufficiently separated from each portion of the body of the rider seated on the seat 47.

In the straddle-type vehicle 1 according to the present embodiment, the second portion 62 of the exhaust pipe 60 is provided with the first catalyst device accommodating portion 73 including the enlarged diameter portion 74, the large diameter portion 75, and the reduced diameter portion 76. Accordingly, the large-sized first catalyst device 71 having a diameter larger than the diameter of each of the first portion 61 and the third portion 63 of the exhaust pipe 60 and having high exhaust gas purification performance can be provided at the second portion 62 of the exhaust pipe 60.

In the straddle-type vehicle 1 according to the present embodiment, the first catalyst device accommodating portion 73 is inclined such that the downstream side end portion of the reduced diameter portion 76 is located above and behind the upstream side end portion of the enlarged diameter portion 74. Accordingly, the curvature of the reduced diameter portion 76 can be reduced. The first catalyst device accommodating portion 73 is inclined such that the downstream side end portion of the reduced diameter portion 76 is located above and to the right of the upstream side end portion of the enlarged diameter portion 74. Accordingly, the curvature of the enlarged diameter portion 74 can be reduced. The first catalyst device accommodating portion 73 is inclined such that the downstream side end portion of the reduced diameter portion 76 is located above, behind, and to the right of the upstream side end portion of the enlarged diameter portion 74, whereby the first catalyst device accommodating portion 73 capable of accommodating the large-sized first catalyst device 71 can be disposed in a region from the lower front of the down frame 5 to the right of the down frame 5 without forming a locally bent portion with a large curvature at the first catalyst device accommodating portion 73. By inclining the first catalyst device accommodating portion 73 in this manner, it is possible to suppress an increase in the size of the straddle-type vehicle 1 while providing the first catalyst device accommodating portion 73 in front of the engine 31 and to the right of the down frame 5.

In the straddle-type vehicle 1 according to the present embodiment, the enlarged diameter portion 74 is increased in diameter and extends from a region in front of the crankcase 32 and to the lower front of the down frame 5 toward a region in front of the crankcase 32 and to the right of the down frame 5 while being bent upward and backward. With this configuration, the downstream side end portion of the first portion 61 of the exhaust pipe 60 that is located to the lower left of the lower end of the down frame 5 and the large diameter portion 75 of the first catalyst device accommodating portion 73 can be easily connected via the enlarged diameter portion 74, the large diameter portion 75 being disposed at a position to the right of the down frame 5, higher than the lower end of the down frame 5, and lower than the exhaust port 36 of the engine 31, and having a diameter larger than that of the downstream side end portion of the first portion 61 of the exhaust pipe 60. The first catalyst device accommodating portion 73 has a monaka structure, whereby the enlarged diameter portion 74 that is bent and increased in diameter can be easily manufactured.

In the straddle-type vehicle 1 according to the present embodiment, the reduced diameter portion 76 is decreased in diameter and extends from a region in front of the crankcase 32 and to the right of the down frame 5 toward a region to the right of the boundary between the cylinder 33 and the cylinder head 34 while being bent backward so as to be close to the horizontal direction. With this configuration, the large diameter portion 75 of the first catalyst device accommodating portion 73 and the upstream side end portion of the third portion 63 of the exhaust pipe 60 that is located to the right of the boundary between the cylinder 33 and the cylinder head 34 can be easily connected to each other via the reduced diameter portion 76, the large diameter portion 75 being disposed at a position to the right of the down frame 5, higher than the lower end of the down frame 5, and lower than the exhaust port 36 of the engine 31, and having a diameter larger than that of the upstream side end portion of the third portion 63 of the exhaust pipe 60. The first catalyst device accommodating portion 73 has a monaka structure, whereby the reduced diameter portion 76 that is bent and decreased in diameter can be easily manufactured.

In the straddle-type vehicle 1 according to the present embodiment, the first catalyst device accommodating portion 73 is disposed below the right radiator 42 in a state of being inclined in the front-back direction such that the upstream side end portion of the enlarged diameter portion 74 is in front of the front surface of the right radiator 42 and the downstream side end portion of the reduced diameter portion 76 is behind the back surface of the right radiator 42. Accordingly, a radiator having a large size in the up-down direction and therefore having a large core area can be adopted as the right radiator 42. Therefore, the cooling performance of the radiator 42 on the cooling water can be enhanced. That is, when the first catalyst device accommodating portion 73 is disposed below the right radiator 42 so as to stand upright in the vertical direction, a radiator having a small size in the up-down direction and therefore having a small core area can be adopted as the right radiator 42 in order to avoid contact between the downstream side end portion of the reduced diameter portion 76 provided at an upper portion of the first catalyst device accommodating portion 73 and a lower end portion of the right radiator 42. On the other hand, in the straddle-type vehicle 1 according to the present embodiment, since the first catalyst device accommodating portion 73 is inclined such that the downstream side end portion of the reduced diameter portion 76 is located behind the back surface of the right radiator 42, even when the lower end portion of the right radiator 42 is located below the reduced diameter portion 76 of the first catalyst device accommodating portion 73, contact between the lower end portion of the right radiator 42 and the first catalyst device accommodating portion 73 can be avoided (for example, the lower end portion of the right radiator 42 can extend downward to a position immediately before the large diameter portion 75 of the inclined first catalyst device accommodating portion 73). Therefore, a radiator having a large size in the up-down direction and therefore having a large core area can be adopted as the right radiator 42. When a radiator having a small size in the up-down direction is adopted as the right radiator 42, the right radiator 42 can be separated from the first catalyst device accommodating portion 73, and it is difficult to transmit the radiant heat from the first catalyst device accommodating portion 73 to the right radiator 42.

In the straddle-type vehicle 1 according to the present embodiment, the first exhaust gas sensor 91 is provided at a portion of the exhaust pipe 60 passing through the region in front of the down frame 5, and is disposed such that the entire first exhaust gas sensor 91 overlaps with the first catalyst device accommodating portion 73 in the side view of the straddle-type vehicle 1. Since the first exhaust gas sensor 91 is provided at the portion of the exhaust pipe 60 passing through the region in front of the down frame 5, the first exhaust gas sensor 91 can be easily attached to and detached from the exhaust pipe 60. Since the first exhaust gas sensor 91 is disposed such that the entire first exhaust gas sensor 91 overlaps with the first catalyst device accommodating portion 73 in the side view of the straddle-type vehicle 1, the first catalyst device accommodating portion 73 can be made to function as a partition wall that suppresses flying stones flying from the right from hitting the first exhaust gas sensor 91, and the first exhaust gas sensor 91 can be protected by the first catalyst device accommodating portion 73. In the straddle-type vehicle 1 according to the present embodiment, the first exhaust gas sensor 91 is disposed such that the entire first exhaust gas sensor 91 overlaps with the first portion 61 of the exhaust pipe 60 in the side view of the straddle-type vehicle 1. Accordingly, the first portion 61 of the exhaust pipe 60 can be made to function as a partition wall that suppresses flying stones flying from the left from hitting the first exhaust gas sensor 91, and the first exhaust gas sensor 91 can be protected by the first portion 61 of the exhaust pipe 60.

In the straddle-type vehicle 1 according to the present embodiment, since the first catalyst device accommodating portion 73 is located to the left of the rightmost portion of the engine 31 and the first portion 61 of the exhaust pipe 60 is located to the right of the leftmost portion of the engine 31, it is possible to suppress an increase in the size of the straddle-type vehicle 1.

In the above embodiment, the second portion 62 of the exhaust pipe 60 (enlarged diameter portion 74 of the first catalyst device accommodating portion 73) extends from the downstream side end portion of the first portion 61 of the exhaust pipe 60 to the right of the down frame 5 through the region to the lower front of the down frame 5. However, when the present invention is applied to a straddle-type vehicle having a long down frame 5, the second portion 62 of the exhaust pipe 60 (enlarged diameter portion 74 of the first catalyst device accommodating portion 73) may extend from the downstream side end portion of the first portion 61 of the exhaust pipe 60 to the right of the down frame 5 through the region in front of the down frame 5.

In the above embodiment, the entire second portion 62 of the exhaust pipe 60 serves as the first catalyst device accommodating portion 73. However, the present invention is not limited thereto, and a portion of the second portion 62 of the exhaust pipe 60 may serve as the first catalyst device accommodating portion 73. For example, the first catalyst device accommodating portion 73 may be provided such that the upstream side end portion of the enlarged diameter portion 74 of the first catalyst device accommodating portion 73 is disposed at a portion of the second portion 62 of the exhaust pipe 60 that is located to the right front or the right lower front of the lower end portion of the down frame 5.

In the above embodiment, the first catalyst device 71 is disposed at a position higher than the lower end of the down frame 5. However, when the present invention is applied to a straddle-type vehicle having a short down frame 5, the first catalyst device 71 may be disposed such that the lower end of the first catalyst device 71 is lower than the lower end of the down frame 5.

The present invention can also be applied to a straddle-type vehicle that does not include the second catalyst device 72. The present invention can also be applied to a straddle-type vehicle that neither includes the first exhaust gas sensor 91 nor the second exhaust gas sensor 92. The present invention can also be applied to a straddle-type vehicle that does not include the left or right radiator 42.

In the straddle-type vehicle according to the present invention, an exhaust port of an engine may be inclined rightward and opened forward, the exhaust pipe may include a first portion extending downward from the exhaust port of the engine through a region in front of the engine and to the right of the down frame, a second portion extending upward through a region in front of the engine and to the left of the down frame after extending from a downstream side end portion of the first portion to the left of the down frame through a region in front of or to the lower front of the down frame, a third portion extending backward from a downstream side end portion of the second portion through a region to the left of the engine, and a fourth portion extending from a downstream side end portion of the third portion to reach a muffler, and the catalyst device may be disposed in a portion of the second portion of the exhaust pipe that is located in front of the engine and to the left of the down frame.

In the above embodiment, the first catalyst device 71 having a diameter larger than that of each of the first portion 61 and the third portion 63 of the exhaust pipe 60 is provided at the second portion 62 of the exhaust pipe 60. However, the present invention is not limited thereto, and a catalyst device having a diameter equal to that of the first portion 61 or the third portion 63 of the exhaust pipe 60, or a catalyst device having a diameter smaller than that of each of the first portion 61 and the third portion 63 of the exhaust pipe 60 may be provided at the second portion 62 of the exhaust pipe 60. When a catalyst device having a diameter smaller than that of each of the first portion 61 and the third portion 63 of the exhaust pipe 60 is provided at the second portion 62 of the exhaust pipe 60, the diameters of the first portion 61, the second portion 62, and the third portion 63 of the exhaust pipe 60 can be made equal to one another, and in this case, the first catalyst device accommodating portion 73 including the enlarged diameter portion 74, the large diameter portion 75, and the reduced diameter portion 76 may not be provided at the second portion 62 of the exhaust pipe 60.

In the above embodiment, the straddle-type vehicle 1 in which the third portion 63 of the exhaust pipe 60 passes through a right side of the boundary between the cylinder 33 and the cylinder head 34 of the engine 31 is taken as an example of a straddle-type vehicle having a structure in which an exhaust pipe passes through a lateral side of an engine without passing below the engine, but the present invention is not limited thereto. The present invention can also be applied to a straddle-type vehicle in which an exhaust pipe passes a lateral side of an upper portion of a crankcase of an engine, a lateral side of a cylinder, or a lateral side of a cylinder head.

The present invention can be applied not only to a straddle-type vehicle for off-road racing but also to a straddle-type vehicle designed to be suitable for both on-road traveling and off-road traveling. When there is a straddle-type vehicle designed to be exclusively suitable for on-road traveling and having a structure in which an exhaust pipe passes a lateral side of an engine, the present invention can also be applied to such a straddle-type vehicle.

The present invention can be appropriately changed without departing from the gist or concept of the invention which can be read from the claims and the entire description, and a straddle-type vehicle accompanied with such a change is also included in the technical concept of the present invention.

What is claimed is:

1. A straddle-type vehicle comprising:

a head pipe;

a main frame extending backward from the head pipe;

a down frame extending downward from the head pipe;

an engine including a crankcase, a cylinder provided above the crankcase, and a cylinder head provided above the cylinder, the engine being disposed below the main frame and behind the down frame;

a muffler disposed behind the engine and configured to reduce exhaust noise of at is discharged from an exhaust port provided in the cylinder head;

an exhaust pipe configured to connect the exhaust port and the muffler and to send the exhaust gas discharged from the exhaust port to the muffler; and a catalyst device provided in an intermediate portion of the exhaust pipe and configured to purify the exhaust gas flowing through the exhaust pipe, wherein the exhaust port is disposed in a front portion of the cylinder head, and is opened forward while being inclined to one side in a left-right direction, the exhaust pipe includes a first portion extending downward from the exhaust port through a region in front of the engine and on one lateral side of the down frame in the left-right direction, a second portion extending upward through a region in front of the engine and on the other lateral side of the down frame in the left-right direction after extending from a downstream side end portion of the first portion to the other lateral side of the down frame in the left-right direction through a region in front of or to a lower front of the down frame, a third portion extending backward from a downstream side end portion of the second portion through a region on the other lateral side of the engine in the left-right direction, and a fourth portion extending from a downstream side end portion of the third portion and reaching the muffler, the catalyst device is disposed in a portion of the second portion of the exhaust pipe that is located in front of the engine and on the other lateral side of the down frame in the left-right direction, and the first portion is disposed at an opposite side of the catalyst device with respect to the down frame.

2. The straddle-type vehicle according to claim 1, wherein the catalyst device is disposed at a portion higher than a lower end of the down frame and lower than the exhaust port.

3. The straddle-type vehicle according to claim 1, further comprising:

an exhaust gas sensor configured to detect a state of the exhaust gas in a portion of the exhaust pipe upstream of the catalyst device, wherein the exhaust gas sensor is provided at a portion of the exhaust pipe passing through a region in front of the down frame, and is disposed such that the entire exhaust gas sensor overlaps with a catalyst device accommodating portion in a side view of the straddle-type vehicle.

4. The straddle-type vehicle according to claim 1, wherein, in a side view of the straddle-type vehicle, the catalyst device overlaps with the down frame.

5. The straddle-type vehicle according to claim 1, wherein the second portion of the exhaust pipe is provided with a catalyst device accommodating portion, the catalyst device accommodating portion includes a tubular enlarged diameter portion whose diameter increases from an upstream side toward a downstream side of the second portion, a tubular large diameter portion connected to a downstream side end portion of the enlarged diameter portion, and a tubular reduced diameter portion which is connected to a downstream side end portion of the large diameter portion and reduced in diameter decreases from the upstream side toward the downstream side of the second portion, and the catalyst device is disposed in the large diameter portion.

6. The straddle-type vehicle according to claim 5, wherein the catalyst device accommodating portion is inclined such that a downstream side end portion of the catalyst device accommodating portion is located above and behind an upstream side end portion of the catalyst device accommodating portion.

7. The straddle-type vehicle according to claim 6, wherein the catalyst device accommodating portion is inclined such that the downstream side end portion of the catalyst device accommodating portion is located above and on the other side in the left-right direction of the upstream side end portion of the catalyst device accommodating portion.

8. The straddle-type vehicle according to claim 6, wherein the enlarged diameter portion is increased in diameter and extends from a region in front of the crankcase and in front of or to the lower front of the down frame toward a region in front of the crankcase and on the other lateral side of the down frame in the left-right direction while being bent upward and backward.

9. The straddle-type vehicle according to claim 6, wherein the reduced diameter portion is decreased in diameter and extends from a region in front of the crankcase and on the other lateral side of the down frame in the left-right direction toward a region on the other lateral side of the cylinder or the cylinder head in the left-right direction while being bent backward so as to be close to a horizontal direction.

10. The straddle-type vehicle according to claim 6, further comprising:

a heat exchanger provided on the other lateral side of an upper portion of the down frame in the left-right direction, wherein the catalyst device accommodating portion is disposed below the heat exchanger in a state of being inclined in a front-back direction such that the upstream side end portion of the catalyst device accommodating portion is located in front of a front surface of the heat exchanger and the downstream side end portion of the catalyst device accommodating portion is located behind a back surface of the heat exchanger.

* * * * *